US007003127B1

(12) United States Patent
Sjursen et al.

(10) Patent No.: US 7,003,127 B1
(45) Date of Patent: Feb. 21, 2006

(54) HEARING AID WITH LARGE DIAPHRAGM MICROPHONE ELEMENT INCLUDING A PRINTED CIRCUIT BOARD

(75) Inventors: Walter P. Sjursen, Bucks County, PA (US); Derek D. Mahoney, Manalapan, NJ (US); John M. Margicin, Levittown, PA (US); Frederick J. Fritz, Skillman, NJ (US); John G. Aceti, Cranbury, NJ (US); David A. Preves, Princeton Junction, NJ (US); Ponnusamy Palanisamy, Lansdale, PA (US)

(73) Assignee: Sarnoff Corporation, Princeton, NJ (US)

( * ) Notice: Subject to any disclaimer, the term of this patent is extended or adjusted under 35 U.S.C. 154(b) by 0 days.

(21) Appl. No.: 09/477,700

(22) Filed: Jan. 6, 2000

Related U.S. Application Data

(60) Provisional application No. 60/115,011, filed on Jan. 7, 1999, provisional application No. 60/134,896, filed on May 19, 1999, provisional application No. 60/157,872, filed on Oct. 6, 1999.

(51) Int. Cl.
*H04R 25/00* (2006.01)

(52) U.S. Cl. ..... 381/322; 381/328; 381/324

(58) Field of Classification Search ..... 381/326, 381/324, 328, 174, 191, 173, 190, 312, 322; 600/25; 607/56, 57
See application file for complete search history.

(56) References Cited

U.S. PATENT DOCUMENTS

| | | | | |
|---|---|---|---|---|
| 3,300,585 A | | 1/1967 | Reedyk et al. | 179/1 |
| 4,286,122 A | | 8/1981 | Iding | 179/111 E |
| 4,533,795 A | * | 8/1985 | Baumhauer et al. | 381/174 |
| 4,559,418 A | | 12/1985 | Imai | 179/111 E |
| 5,255,246 A | | 10/1993 | van Halteren | 367/170 |
| 5,303,305 A | | 4/1994 | Raimo et al. | 381/68 |
| 5,589,799 A | | 12/1996 | Madaffari et al. | 330/277 |
| 5,809,158 A | | 9/1998 | van Halteren et al. | 381/200 |
| 5,920,090 A | | 7/1999 | Stenberg | 257/252 |
| 6,366,678 B1 | * | 4/2002 | Madaffari et al. | 381/324 |
| 6,456,720 B1 | * | 9/2002 | Brimhall et al. | 381/324 |

FOREIGN PATENT DOCUMENTS

| | | |
|---|---|---|
| EP | 533 284 A1 | 3/1993 |
| EP | 549 200 A1 | 6/1993 |
| EP | 802 700 | 10/1997 |
| EP | 800 331 | 1/1998 |
| WO | WO 97/01258 | 1/1997 |

* cited by examiner

*Primary Examiner*—Huyen Le
*Assistant Examiner*—Tuan Duc Nguyen
(74) *Attorney, Agent, or Firm*—Hamilton, Brook, Smith & Reynolds, P.C.

(57) ABSTRACT

A disposable-type hearing aid uses a relatively large single diaphragm or a large single diaphragm subdivided into a plurality of smaller active diaphragm areas obtained using a grate-like back support plate with ridges which contact and divide the diaphragm into the several smaller active diaphragm areas. The diaphragm and a backplate are enclosed in a metal housing and are disposed proximal and parallel to a shell-like hearing aid enclosure having sound inlets. The metal housing is closed at an end opposite the sound inlets by a printed circuit board (PCB) forming an acoustical seal for a back volume of the microphone. The PCB also carries substantially all the electronic components for the hearing aid thereon. The PCB has a ground plane in contact with the housing whereby the PCB also acts as an EMI shield. An electrical connection is formed in various ways between the back support plate and the PCB during assembly of the metal housing and components with the PCB. Mass production of disposable hearing aids with large diaphragms and relatively low noise levels is thus possible using this invention.

4 Claims, 20 Drawing Sheets

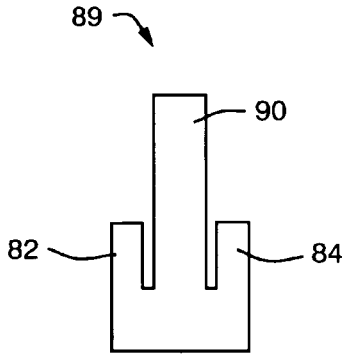
FIG. 9A
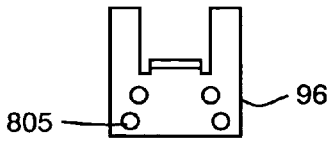
FIG. 9B
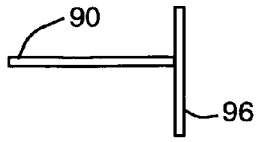
FIG. 9C
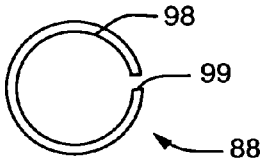
FIG. 10A
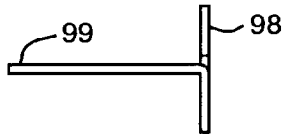
FIG. 10B
FIG. 11A
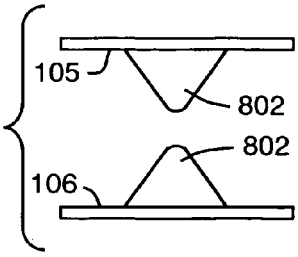
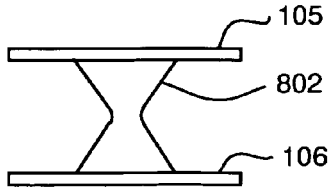
FIG. 11B
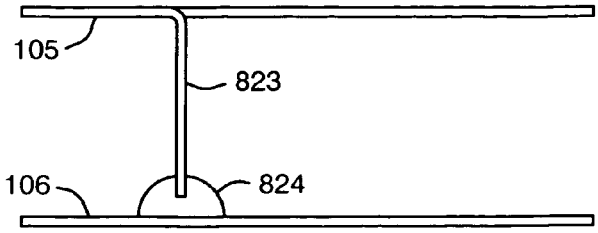
FIG. 12

HEARING AID WITH LARGE DIAPHRAGM MICROPHONE ELEMENT INCLUDING A PRINTED CIRCUIT BOARD

RELATED APPLICATIONS

This application claims the benefit of U.S. Provisional Application Ser. No. 60/115,011, filed on Jan. 7, 1999, U.S. Provisional Application Ser. No. 60/134,896, filed May 19, 1999 and U.S. Provisional Application Ser. No. 60/157,872, filed Oct. 6, 1999, and U.S. patent application entitled "Microphone Assembly for Hearing Aid With JFET Flip-Chip Buffer", filed date on Jan. 6, 2000, now U.S. Pat. No. 6,366,678, the contents of each of which is incorporated herein by reference.

BACKGROUND OF THE INVENTION

The performance of a hearing aid depends, among other things, upon the design of the microphone pickup. The microphone is a substantial part of the hearing aid. Further, where a hearing aid uses a circuit board which requires electrical connections to be completed during the hearing aid assembly, the ease and simplicity with which the electrical connections can be made impacts the cost of manufacture. Hearing aids which can be manufactured at relatively lower cost are desirable, since they can be disposed of after use.

Examples of the use of hearing aid microphones or transducers are known in published literature.

U.S. Pat. No. 5,388,163 to Elko et al. teaches an electret foil transducer array comprising an electret foil having a layer of insulating material and a layer of metal in contact therewith. The transducer portion of the array comprises one or more discrete areas of foil with the surrounding areas removed. Alternatively, the discrete areas of foil could be formed by selective metal deposition. Electrical leads are coupled to the discrete areas of metal. By means of the electrical leads, electrical signals produced by each transducer in response to acoustic signals which become incident in use on the areas of foil are used for further processing. The electret foil is made up of the discrete areas of foil with a backing of polytetrafluoroethylene PTF or, alternatively, Mylar®. The electret foil is backed by a porous backplate (e.g., of sintered aluminum) with a rough surface to provide air channels. The porous backplate may be supported by a uniformly supporting metal screen to provide increased rigidity.

Nevertheless, despite such prior art, a need exists for a hearing aid with a relatively large diaphragm and improved low noise microphone characteristics performing with high efficiency, which is capable of being manufactured at low cost and economy, thereby facilitating the manufacture of hearing aids which are sufficiently inexpensive so that they can be disposed of after short periods of use. Additionally, there is a need for a hearing aid wherein electrical connections, which need to be made during manufacture, can be completed in a simple and economical manner and in a less labor intensive and effective process.

SUMMARY OF THE INVENTION

This invention is directed in particular, to disposable hearing aids, i.e., inexpensive hearing aids capable of lasting at least a limited period of time. Traditional hearing aids use microphones having relatively small size diaphragms, generally of the capacitive or electret type. Microphones for the hearing aid industry have continually become smaller in design, allowing hearing aids to also become smaller. However, as these microphones become smaller, they tend to become more expensive. This invention, inter alia, aims at reducing the cost of manufacturing the microphone assembly while maintaining high performance and at the same time allowing for automated assembly of the microphone into the hearing aid electronics. These goals will allow manufacturing cost of hearing aids to be lowered significantly, which is necessary to enable manufacture of disposable hearing aids.

The invention, in one embodiment, resides in a disposable hearing aid including an electret type microphone comprising a metallic diaphragm having a front face on which sound waves impinge in use. The diaphragm is glued to a grate-like support plate placed in apposition to and supporting the metallic diaphragm on its back face. The metallic diaphragm consists of a thin plastic film such as PTF coated with a metallic layer. The support plate functionally divides the diaphragm into a plurality of active diaphragm areas which produces a single transducer output whereby the sound waves are converted to electrical pulses. In this way, the advantages of low noise generation in a relatively large diaphragm owing to its larger area and higher capacitance are retained without sacrificing performance and economy.

Another embodiment of the invention uses an open-ended metal housing which is enclosed at the open end by a printed circuit board (PCB) carrying all the components needed for signal processing. An electrical connection is made between the printed circuit board and the microphone backplate for coupling the electrical pulses from the diaphragm areas to electrical components for signal processing. Different types of electrical connections which lend themselves effectively for mass production without sacrificing quality are described herein. In addition, the PCB has a ground plane connected to the metal housing to provide an EMI shielding.

In another embodiment of the invention, a large diameter capacitor microphone such as an electret microphones commonly used in hearing aids is provided. Traditional hearing aid microphones generally have a single circular or rectangular diaphragm of relatively small dimensions. A large diaphragm microphone herein is used in the disposable hearing aid of the invention to increase sensitivity and to reduce noise. Because the microphone does not have to share space on the hearing aid faceplate with an access door to the hearing aid battery a large diaphragm microphone can be employed which is disposed parallel and proximal to the hearing aid faceplate. The faceplate is provided with multiple inlet holes resulting in improved noise performance and unrestricted flow of sound to the microphone. However, a single large diaphragm has the problem of instability. As the charge on the capacitor is increased to increase sensitivity, the diaphragm is attracted towards the backplate with a higher force. As the distance between the diaphragm and the backplate decreases, the force increases. At some point, the diaphragm becomes unstable, and is attracted to and might stick to the backplate, rendering the hearing aid nonfunctional. The present invention minimizes the instability problem of large diaphragms and provides a hearing aid construction which is inexpensive, reliable, and economical. It also simplifies an electrical connection in the hearing aid which can be accomplished during the step of assembly of the hearing aid.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

A more detailed understanding of the invention may be had from the following description of preferred embodiments, given by way of example and to be understood in conjunction with the accompanying drawing, wherein:

FIGS. 9A, 9B and 9C show steps in the process of forming a wire connection according to one embodiment FIG. 10A is top view of an alternate wire connection.

FIG. 10B is a side view as in FIG. 10A.

FIG. 11A is a side view of a first step in forming another connection.

FIG. 11B shows the completed connection.

FIG. 12 shows an alternate connection.

FIG. 23B is an enlarged schematic detail of the JFET buffer portion of FIG. 22 prior to assembly.

DETAILED DESCRIPTION OF THE EMBODIMENTS

Figure 1:
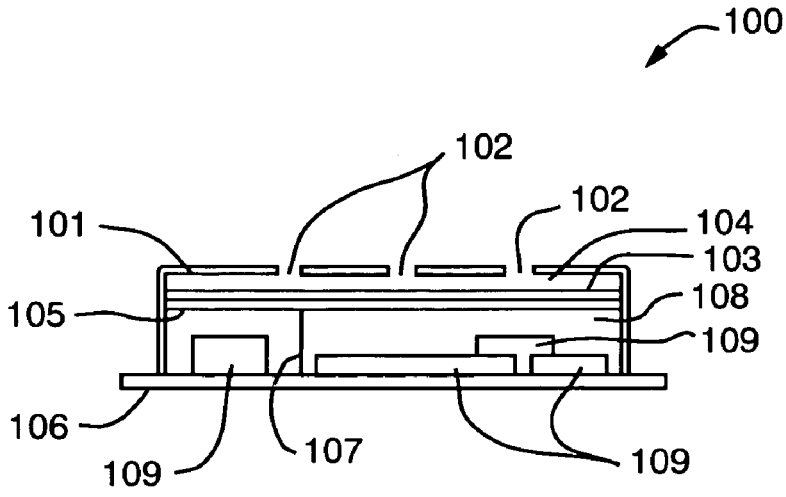
FIG. 1 is a schematic cross-sectional view of a microphone assembly having a large diaphragm enclosed in a housing with the complete electronic components and a PCB included for a hearing aid.

FIG. 1 shows a first embodiment of the invention illustrated pictorially in a cross sectional view of a hearing aid microphone assembly 100. A metal housing 101 adapted to be disposed inside an enclosure such as the enclosure 408 shown in FIG. 4; with sound inlets 102 contains, inter alia, front chamber 104, a diaphragm 103, a backplate 105, a back chamber 108, and electrical components 109. In addition, a printed circuit board 106 on which the components are mounted, and an electrical connection 107 is included in the housing 101, thereby providing all the electrical components (except the battery and a receiver) required for a hearing aid. The diaphragm 103 consists of a sheet of a thin flexible material (e.g., metallized mylar) that is stretched tight and glued to a support element 501. As shown in FIGS. 5 and 6, the support element 501 may take many shapes. In the FIGS. 5 and 6 embodiments, a separate spacer is inserted between the diaphragm (with its support element) and the backplate 105. The separate spacer maintains an accurate distance between the diaphragm and the backplate. Also, in such embodiments, the backplate 105 is coated with a thin layer (typically about 1 mil) of Teflon® and charged.

The sound inlets 102 may be in the form of perforations in the metal housing, or a single opening about equal to or less than the diameter of the diaphragm to enable external sound to pass through the ports 409 in the faceplate of enclosure 400 and impinge on the front of the diaphragm so as to enable the hearing aid to perform its function. The perforations/openings 102 lead to the front chamber 104, which is partly defined by the laterally extending diaphragm 103. As shown, this embodiment of the invention comprises an electret microphone element mounted to cooperate with a printed circuit board 106 containing the hearing aid electronics 109. The microphone housing 101 may be acoustically sealed to the printed circuit board (PCB), for example, by epoxy resin (not shown) applied at the periphery of the base of the housing as it interfaces the PCB 106, thereby providing a sealed back chamber for the microphone assembly. Other methods of joining and sealing the microphone to the PCB are within the scope of this invention.

The backplate 105 is electrically connected to electronic components in one of several ways. FIG. 1 shows a direct electrical connection to a conductive trace (not shown) on the PCB 106. The backplate signal then proceeds along the conductive trace on the PCB to connect to other electronic components which may, for example, be a separate buffer amplifier or an integrated circuit containing a buffer amplifier as will be discussed later in connection with FIGS. 2 and 20–24. Using the connection method shown in FIG. 1, the PCB 106 must be of high enough impedance so as not to degrade performance of the microphone. This will restrict the materials that may be used for the PCB and, hence, may drive up the cost of the PCB. Metal housing 101 is one terminal of the microphone element and is electrically connected to circuit ground. With the physical configuration shown in FIG. 1, the metal housing 101 is either soldered to a metal trace on the PCB 106, or connected with conductive epoxy to the conductive trace on the PCB.

A support element facilitates functionally-dividing the diaphragm 103 into a plurality of smaller sized active diaphragm areas, the output of which is spatially coupled from backplate 105 to connector 107 for processing by the electronic components 109 on the PCB 106. Note: The term "spatially coupled" means that no output lead is attached to each active diaphragm area. Rather a single connection is made to a point on the backplate to obtain the voltage change output from the backplate representing the summation of all the voltage modulations induced in the microphone by the acoustic/sound wave input to the diaphragm.

FIGS. 8 and 16–18 show some of the details of the backplate 105, which is electrically conductive and has spaced ridge formations or spacer bumps 326, which are provided to contact the diaphragm at certain locations to facilitate dividing the large diaphragm 103 into smaller functional active diaphragms areas. The ridge formations can be of several desired configurations, such as, for example, triangular, semicircular, square, or trapezoidal cross section. Details of an alternate method of dividing the diaphragm will be provided in connection with FIGS. 5 and 6.

The backplate is electrically connected to the printed circuit wiring board 106 during assembly of the hearing aid. Details of the electrical connections are discussed in the description relating to FIGS. 8–14.

Figure 2:
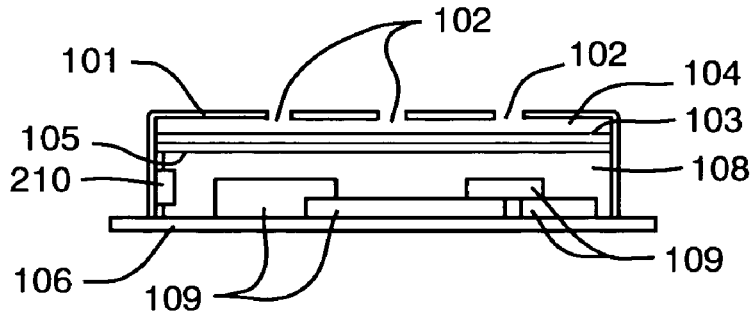
FIG. 2 is a view similar to that in FIG. 1, but including a buffer/amplifier.
Figure 3:
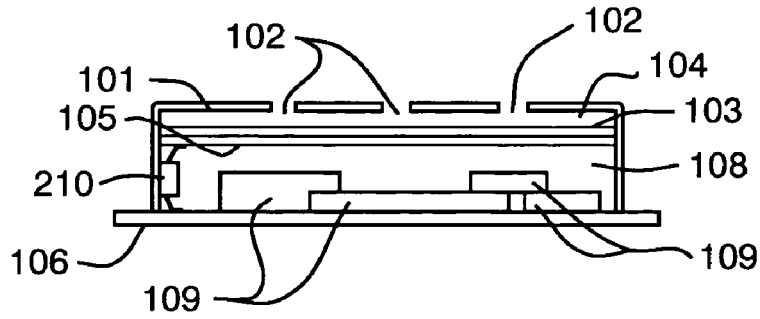
FIG. 3 is a view similar to that in FIG. 1, but including a spring contact type electrical connection between the backplate and PCB.

An alternative embodiment of the invention will now be described in connection with FIG. 2. In this embodiment, a separate buffer/amplifier 210 is connected between the microphone backplate 105 and the PCB 106. The buffer/amplifier 210 has a very high input impedance suitable for use with an electret microphone element. Also, the buffer/amplifier 210 may be a unity gain buffer (e.g., a source follower), or a low-noise amplifier with gain. A typical gain might be 10 to 20 dB. This input to the buffer/amplifier 210 is electrically connected from the backplate. Suitable methods of making the connection to the backplate include, but are not limited to, welding the lead from the buffer/amplifier 210 to the backplate, or using conductive epoxy (not shown). The buffer/amplifier 210 may be attached to the side of the microphone housing 101 with epoxy (as shown in FIG. 2) or with other suitable means. The power, ground, and output signal leads of the buffer/amplifier 210 are connected to the respective contacts (not shown) on the PCB. As shown in FIG. 3, the leads are preferably bent to lay flat on the PCB. Solder or conductive epoxy may be used to make the electrical connection to the PCB. If the leads are made of a resilient/springy material (i.e., beryllium copper), the leads may make a spring contact with the PCB, and solder or conductive epoxy would be unnecessary. In yet another embodiment, the separate buffer/amplifier 210 would not be attached to the side of the microphone housing, but rather would be suspended between the backplate and the PCB by its electrical connections.

Figure 4:
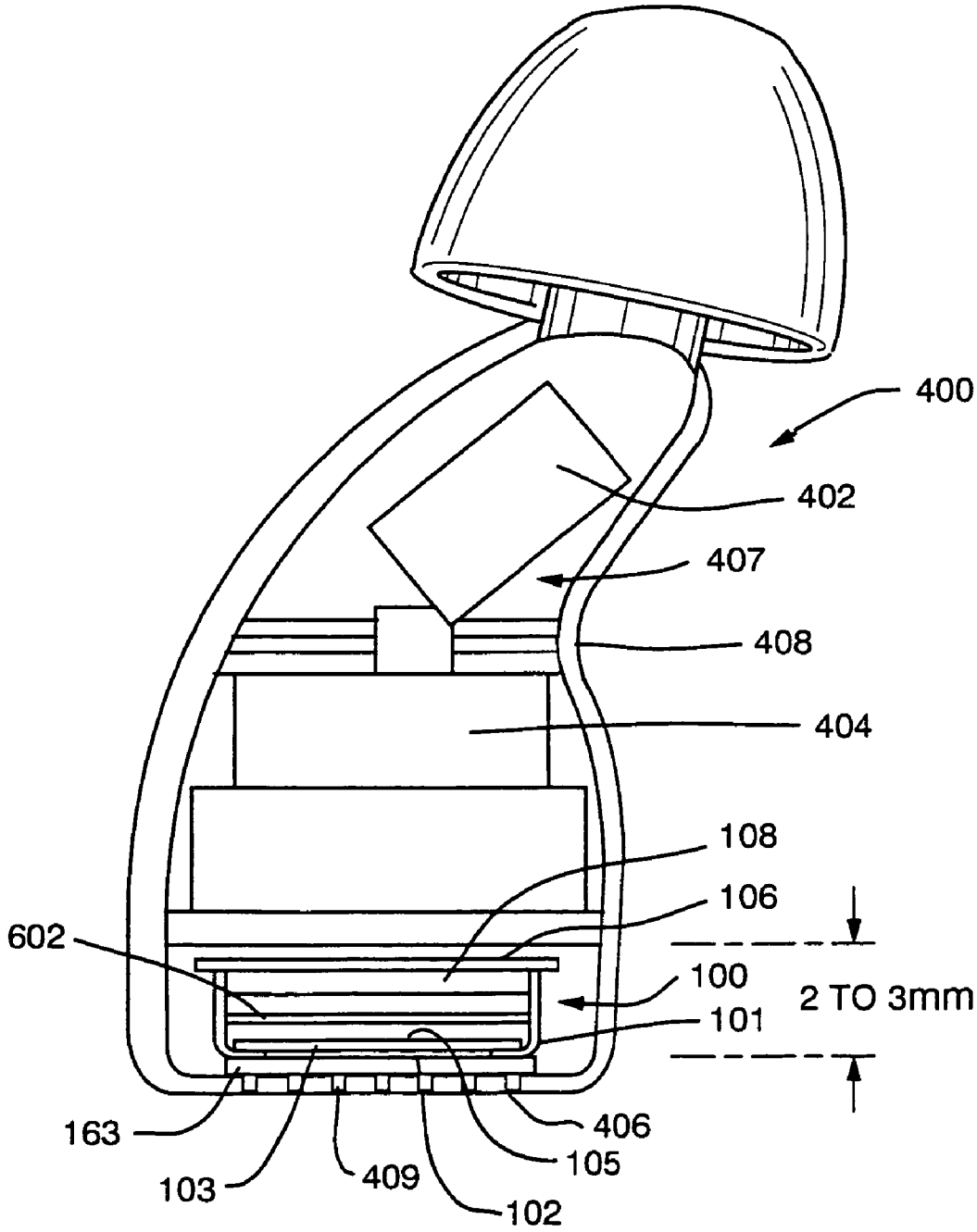
FIG. 4 is a partial cross section view of a disposable hearing aid in accordance with the invention with a microphone assembly and in an enclosure in which the present invention can be implemented.

FIG. 4 illustrates an alternate hearing aid microphone assembly 100 (described in more detail in connection with FIGS. 22 and 23). The assembly 100 is disposed at a proximal end of an enclosure 408 for a disposable hearing aid 400. The microphone including the housing 101, diaphragm assembly 103/105, and a back-end PCB 106 is shown to be about 2–3 mm in longitudinal length "L". The shorter the microphone assembly 100 is, the better for purposes of wearing by a user. The microphone housing 101 occupies a substantial portion of the diameter adjacent the faceplate 406. A flex circuit (not shown) may be used to couple the amplified output of the microphone from the PCB components 109 to a receiver 402 at the distal end of the hearing aid 400. A stepped battery 404 is provided between the microphone and the receiver/speaker end 407. Since the hearing aid 400 is disposable, the battery 404 may be permanently connected to the circuit elements and does not need to be accessed. The need to access the battery is a disadvantage. In prior art devices, an access door was required on the hearing aid faceplate 406 at the proximal end of the enclosure 408 of the hearing aid 400. Traditionally, the access door would be located where the faceplate 406 of the molded shell-like enclosure 408 containing the hearing aid components is located. The battery access door is normally located on the faceplate since it is a surface not in contact with the ear canal, thereby minimizing ingress of contaminants and potential irritation. In the prior art non-disposable hearing aids, both components i.e., door and microphone, would have to share the same space on the faceplate. The diaphragm for the microphone would, therefore, be substantially smaller than the faceplate.

To the contrary, in the invention shown in FIG. 4, the microphone diaphragm occupies a substantial portion of the entire surface area adjacent the faceplate 406. Moreover, because the microphone diaphragm 103 is located proximally adjacent to the faceplate unrestricted sound is allowed to flow through sound ports 409 provided in the faceplate 406 only a short distance from the diaphragm 103. Thus, hearing aid 400, not only provides a large area diaphragm, but the microphone assembly provides a high aspect ratio for a hearing aid, in the sense that, the width W versus length L of the microphone assembly versus assembly length is greater than 2:1 whereas in the past, many microphones were of necessity disposed perpendicular to the faceplate so that the aspect ratio was less than 1:1.

Figure 8:
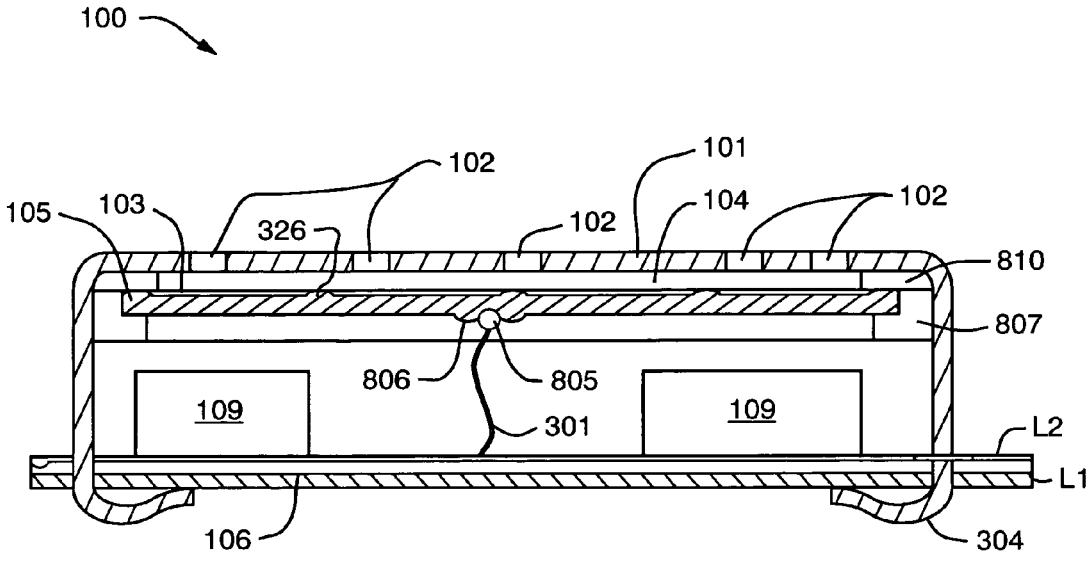
FIG. 8 is an enlarged diagrammatical cross section of a microphone assembly and electronics for a hearing aid according to one embodiment of the invention.

FIG. 8 shows an embodiment of the invention in which a spring contact element 301 is used to make the electrical connection between the backplate and the PCB. The spring contact element may be permanently connected to the backplate with the spring contact contacting at the PCB side. In another configuration, the spring contact is made at the backplate and the permanent connection made at the PCB side. In yet another configuration, spring contacts may be used at both the backplate and the PCB sides.

The PCB 106 may contain one or more copper layers L1, L2 for making electrical connections to signal components, and to ground. The PCB may either be a rigid board (e.g., glass epoxy FR-4) or a flex-circuit (e.g., polymide). Other details of PCB construction are well known in the industry. Preferably, the PCB contains at least two layers L1, L2 of which one layer is substantially a power or ground plane, and in conjunction with the metal housing provides electrical shielding of the integral electronics from interference, i.e., EMI. In one embodiment, the PCB extends beyond the metal housing (as shown) in FIG. 8. Electrical pads or terminals may be positioned on the PCB. In the embodiment shown in FIG. 8, these terminals may be located outside the metal housing to make electrical connections to other components such as a battery 404 or to a receiver (see FIG. 4). This allows easy connections of a mechanical on/off switch spring element (not shown) and a wire harness (not shown) for electrical connections to the receiver and the negative terminal of the battery. The battery has a diameter of about the same dimensions as the metal housing 101 of the microphone. Therefore, there is not much room to make electrical connections to the PCB 106 within the diameter of the metal housing 101. In the embodiments of the invention shown in FIGS. 20 and 21, the PCB 106 does not extend beyond the metal housing of the microphone. In these embodiments, the electrical connections to the PCB 106 must be made within the bounds (i.e., diameter) of the metal housing 101.

It is envisioned that at least one of the electrical components 109 within the metal housing is an integrated circuit that provides certain hearing aid functions. Preferably, only one integrated circuit is needed. This single integrated circuit contains a high-impedance buffer to interface with the high-impedance electret microphone element, the signal processing circuitry of the hearing aid, and an output amplifier to drive a receiver. In an alternative embodiment, the high-impedance buffer/amplifier is external to the main integrated circuit of the components 109. In addition to the components disclosed herein, only a battery and receiver are needed to functionally complete the electronics of a hearing aid.

As previously noted, the microphone element and, in particular, the diaphragm 103 of the microphone of this invention, is much larger than in traditional microphones. The microphone element disclosed herein is simple in construction and less costly to manufacture than traditional hearing aid microphones. The large diaphragm has a higher capacitance, and hence, lower impedance, than traditional hearing aid microphones. This results is lower noise than in traditional hearing aid microphones. Also, the large diaphragm microphone achieves higher sensitivity than traditional microphones. These features allow a lower cost, standard CMOS process to be used for the high-impedance buffer, and still provides low system noise. Traditional microphones require a more expensive JFET, BICMOS, or special low-noise CMOS process to implement the low-noise high-impedance buffer. Since this invention allows standard CMOS processes to be used, the complete hearing aid electronic system can be included in a single integrated circuit, thereby minimizing system costs.

One aspect of the inventive concept lies in the use of multiple diaphragm portions of different areas to improve the performance of the microphone. An additional advantage is that the microphone is mounted parallel to and adjacent to the faceplate which faces outwardly from the inner ear to provide an optimal acoustical path for sound to reach the microphone diaphragm. It is desirable to keep this acoustical path as short as possible, to obviate undesired resonance, which may otherwise be introduced into the frequency response of the hearing aid system. These undesired resonances will degrade the sound quality of the hearing aid. In the embodiment of FIG. 8, a microphone with a large diaphragm is divided by bumps 326 in another embodiment (FIG. 6), a frame-like support structure permits the large diaphragm to be divided into multiple diaphragms having different areas acting together. In either case, the diaphragm is disposed substantially parallel to the faceplate and located just behind the faceplate, with a short acoustical path to external sound waves for improved performance and, in particular, improved sound quality with low noise.

The following data provides an insight into how the inventive hearing aid with a large area microphone with increased area and a high capacitance results in a relatively low noise device without sacrificing performance. A typical prior art type hearing aid microphone diaphragm may have a circular shape, measuring 2 mm in diameter with an area of 3.14 sq mm. A typical large area diaphragm microphone built using the concepts of this invention will have a diameter of 4 mm with an area of 12.6 sq mm. The improvement between the large area diaphragm and the prior art smaller diaphragm is shown in Table 1 below.

TABLE 1

| | Conventional microphone | Inventive microphone |
|---|---|---|
| area | 3.14 $mm^2$ | 12.6 $mm^2$ |
| active capacitance | 0.557 pF | 2.227 pF |
| estimated stray (i.e., parasitic) capacitance | 1 pF | 1 pF |
| total capacitance (active and stray capacitance) | 1.557 pF | 3.227 pF |

The capacitance of the diaphragm is given by the following equation:

$$C-\epsilon.A/d$$

wherein C is the active capacitance of the microphone (in farads), $\epsilon$ (epilson) is the permittivity of air and has a value of $8.859\times10^{-12}$ F/m, and d is the distance between the diaphragm and the backplate (in meters). For the example, d has a value of 50 $\mu$m.

Figure 7:
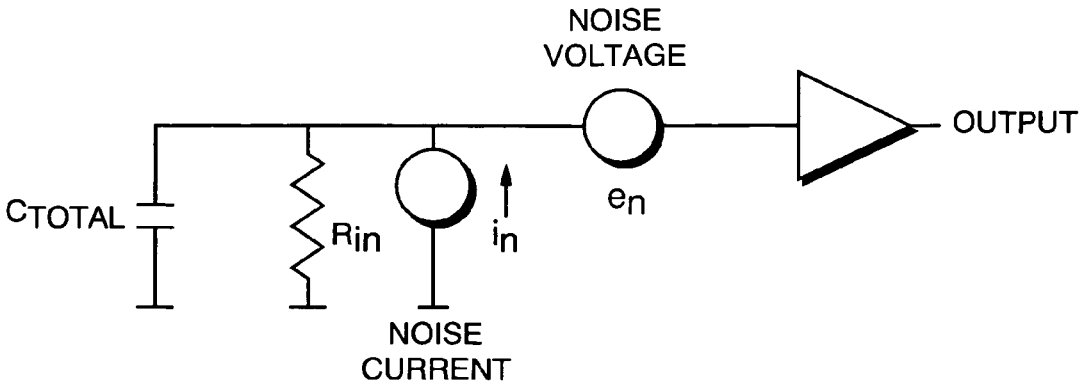
FIG. 7 is an electrical schematic of a noise model for the noise output from an electret microphone.

FIG. 7 shows an exemplary noise model circuit wherein the total noise produced in a diaphragm is expressed as a function of the total capacitance $C_{total}$, resistance value R which is shown as $R_{in}$ in the diagram, the noise current $i_n$ and the noise voltage $e_n$, which are the parameters which influence the output. As explained supra, as the value of total capacitance C increases, the noise contribution due to $i_n$ decreases. The total noise is, in effect, inversely proportional to C, and C in turn is directly proportional to the diaphragm area, whereby it is clear that diaphragms with a relatively large area contribute less to the noise generated, resulting in lower noise in the amplified sound for the user.

From the noise model illustrated in a diagrammatical form in FIG. 7, $$\text{total noise} = \sqrt{\left(i_n \frac{R}{1+SRC}\right)^2 + e_n^2},$$

$$\text{where } C = C_{total} \text{ and } R = R_{in}$$

As C increases, the noise contribution due to $i_n$ decreases. Therefore, relatively larger area diaphragms which result in relatively large values of C improve the signal to noise ratio by decreasing the noise content.

As discussed later in connection with FIGS. 6A and 6B, a support structure 501 may be provided to divide a large area diaphragm into multiple active areas. These areas can be tailored to provide smoother response characteristics.

Neglecting air loading on the diaphragm, the frequency of natural oscillation of the first radial mode of a thin circular membrane (diaphragm) of radius R is given by:

$$f_1 = \frac{1.2}{\pi R}\sqrt{\frac{v}{p}} \tag{1}$$

where v is the tension per unit area at the circumference and p is the mass per unit area. The second, third, and fourth modes are related to the first mode by:

$$f_2 = 2.3(f_1)$$

$$f_3 = 3.6(f_1)$$

$$f_4 = 4.9(f_1)$$

For a microphone in which the first mode is at 3.0 kHz, the second, third, and fourth modes are at 6.9 kHz, 10.8 kHz, and 13.8 kHz respectively. If multiple diaphragms of different diameters are used, the resonant frequencies will also be different and the overall frequency response of the microphones can be made smoother than single-size diaphragms. The diaphragms need not be circular. Calculations for the resonant frequencies of non-circular diaphragms, and in particular of odd-shaped diaphragms, are beyond the scope of this disclosure. Those skilled in the art will recognize that finite-element-analysis (FEA) software programs can be used to determine the resonant frequencies of odd-shaped diaphragms.

As will be described in further detail, the benefits/features of this invention disclosed herein include the following:

(1) A support structure that divides a large, unstable diaphragm into smaller, stable active diaphragm areas;

(2) A non-circular diaphragm support maximizes active diaphragm area and hence, maximizes microphone sensitivity; and (3) Non-equal diaphragm supports distribute resonant frequencies and hence, provide smoother overall frequency response.

The present invention provides a hearing aid overcoming the disadvantages of prior art by selectively combining (i) the functional advantages of a large diaphragm, (ii) the advantages offered by a plurality of smaller diaphragms, which may or may not be of the same size, (iii) a simple construction to effect electrical connection between a printed circuit board and a backplate of the diaphragm, during assembly, (iv) the advantage of the ability to use a single integrated circuit, and (v) the advantage of the microphone being mounted in parallel with and up against a faceplate, to provide an optimal acoustical path for sounds to reach the microphone diaphragm so that an inexpensive standard low cost CMOS process can be used to complete the hearing aid electronic circuit. The above features enable lower cost hearing aids to be manufactured, thus enabling the hearing aids to be made disposable, without sacrificing superior performance.

Figure 5A:
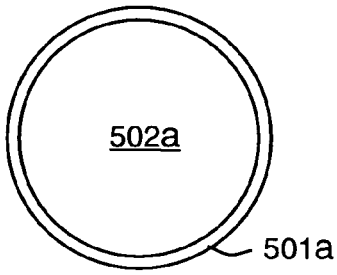
FIG. 5A is a plan view of a large area single circular diaphragm.
Figure 5B:
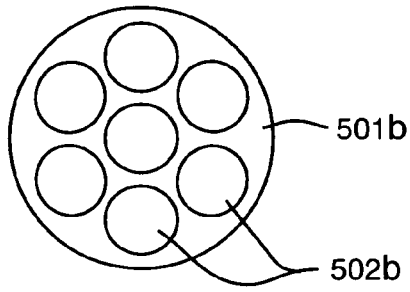
FIG. 5B is a plan view of a diaphragm having a support structure which is used in the present invention.

In FIGS. 5A and 5B, a single large diaphragm 502A configuration is compared with a multiple diaphragm configuration of the invention (FIG. 5B) of the same overall size. In this configuration, seven individual circular diaphragms 502B are shown, although more or fewer diaphragms may be used. The larger circular support structure 501A is about 9.5 mm in diameter. The support structure 501B divides the diaphragm into seven active microphone diaphragm areas 502B of about 2.5 mm diameter each.

The active area of the single diaphragm of FIG. 5A is about 57 $mm^2$, while the active area of the multiple smaller diaphragms shown in FIG. 5B is about 34 $mm^2$. The support structure 501B represents the inactive area that contributes to parasitic capacitance and may slightly reduce the sensitivity of the microphone.

Figure 6A:
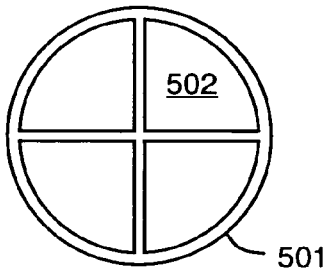
FIGS. 6A and 6B show plan views of a large diaphragm divided into four sectional diaphragms of equal size, FIG. 6A, and four sections of equal size and one of dissimilar size, FIG. 6B, respectively.
Figure 6B:
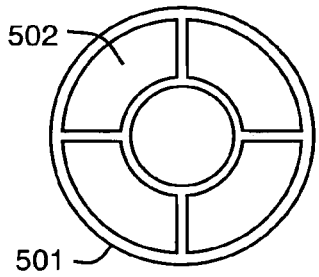

FIGS. 6A and 6B show two embodiments that provide multiple diaphragms with increased active area compared with the embodiment of FIG. 5B. In FIG. 6A, four active diaphragms of areas 502 of equal size are shown. The diaphragms are not circular, but rather they are pie-shaped quadrants, to maximize the active diaphragm area. The overall circular diaphragms may be divided into more or fewer than four sections as shown. By minimizing the area of the support structure 501, and hence, maximizing the active diaphragm area, the active capacitance is increased and the parasitic capacitance is decreased. The active area of the configuration of FIG. 6A is about 48 $mm^2$. The active area of the configuration of FIG. 6B is about 49 $mm_2$. FIG. 6A has four equal-size active diaphragm areas 502, hence the resonant frequencies of each diaphragm will be the same. FIG. 6B has two different sized active diaphragm areas and hence will have two different sets of resonant frequencies. The active diaphragm area arrangements may comprise a plurality of areas, all of similar or different sizes and shapes. The sizes, and hence, the resonant frequencies, may be chosen to optimize the frequency response. In general, the optimization will provide a smoother response than normally obtained with a single-size diaphragm.

In summary, FIGS. 5A, 6A, and 6B show a large diaphragm which can be used with a support structure, wherein the active area of the diaphragm is divided so as to create several smaller active diaphragm regions 502 each acting as individual diaphragms. Each arrangement shown in FIGS. 5B, 6A, and 6B has its own suitable support structure 501. The arrangements shown in FIGS. 5A, 6A, and 6B offer the advantages of large capacitance and hence, an improved signal to noise ratio.

FIG. 8, as previously discussed, illustrates an exemplary cross section of a large diaphragm microphone assembly, wherein the electrical connection between the backplate 105 and the PCB 106 is established by a spring contact 301. The cross section shown in FIG. 8 includes a housing 101, sound inlets 102, a charged diaphragm 103, a backplate 105 functioning as a support plate, a retainer ring 807, electronic circuit components 109, and a PCB 106. A spring contact 301 which is electrically attached to the PCB 106, by virtue of its configuration and resilience, makes electrical contact after assembly with conductive backplate 105. In general, only one electrical contact is needed. The electret microphone is a capacitor with a permanent charge. Since q=c·v, where q equals the charge, c equals the capacitance and v equals the voltage across the capacitance, if q is fixed (as it is in the electret microphone) as sound impinges upon the diaphragm (one plate of the capacitor), the diaphragm vibrates which in turn modulates the capacitance. As the capacitance modulates (changes), and with charge fixed, the voltage across the capacitor also modulates (changes). This changing voltage represents the sound pressure waveform (i.e., sound) impinging upon the diaphragm. The diaphragm is held at ground potential, therefore, this changing voltage appears at the backplate 105. To couple this signal into the electronics, the backplate is coupled to the PCB, which in turn connects the signal through a conductive trace (not shown) to the signal processing electronics 109. The diaphragm 103 and metal housing 101 are both connected to ground in this embodiment and act as an electromagnetic shield. Different configurations for the spring contact 301 are conceivable, and are within the scope of this invention. Spacer bumps 326 on the backplate 105 facilitate functionally dividing the area of the charged diaphragm 103 into smaller sized active diaphragm areas, without losing the advantages of the larger capacitance and consequent lower noise contributed by a large diaphragm. Other alternative provisions, e.g., a ridge or the like, may be used to, to facilitate dividing the diaphragm area into smaller active portions.

The cost of a hearing aid depends largely on the degree of automation and the number of parts and processes needed in large-scale manufacturing. The following description addresses some possible variations in the design of the electrical contact between the backplate and the PCB, which is a difficult, expensive, and a critical aspect of the manufacture.

The electrical connection between the backplate of the microphone and PCB is difficult and critical because it is completed by an act of assembly of the housing with the printed circuit board during manufacture. The connection needs to have minimum capacitance to the sidewalls; therefore, the connecting body must be very thin and, therefore, fragile. The connector is required to be just the correct length to bridge the gap between the backplate and the PCB.

A first approach to making the connection is shown in FIGS. 9A–9C. A thin metal conductor 89 is formed generally in the shape shown in FIG. 9A with a long center tab 90 and two shorter side tabs 92 and 94. For example, the conductor 89 may be formed of 0.001" thick copper. When the center tab 90 is bent up 90° as shown in FIGS. 9B and 9C, the base 96 which remains can be placed on solder dots 805 of a pad on a PCB and soldered along with the rest of the circuit components on the PCB. Four small solder dots (shown in phantom) are better for stability than one large dot. If the length of the center lead 90 is formed to be less than the assembled distance between the PCB and the backplate, an electrically conductive epoxy dot can be placed on the backplate to line up with this lead at assembly. When the assembly is made, the lead penetrates the epoxy dot to make the connection. The epoxy dot is sufficiently large to compensate for any tolerance build up in the assembled parts.

If the center lead is formed to be greater than the distance between the assembled backplate 105 and the PCB 106, the lead 90 will buckle as it interfaces with the surface of the backplate during assembly as shown in FIG. 8. If the parts are gold-plated, this pressure contact may be sufficient to complete the assembly. An electrically conductive epoxy dot 805 on the backplate could also be part of this contact version if needed. To aid in controlling the position of the long contact lead as it stabs the backplate during assembly, a depression 806 can be formed in the backplate to corral the lead as shown in FIG. 8.

In each of the above versions, a small, pre-bent portion in the center lead will act as a strain relief during the life of the product as shown in FIG. 8. It is obvious that many other shapes and bends can be used that are similar to those in the description above.

FIGS. 10A and 10B show another approach to making this connection by using a conductive wire 88. A length of wire with a ring 98, formed at one end and bent approximately at 90° to the wire can be soldered to a pad on the PCB. The other end 99 can mate with the backplate similar to the contact in FIG. 9.

FIGS. 11A and 11B show a method of making electrical contact without any extra parts. A very thick electrically conductive epoxy dot 802 can be placed on both the PCB 106 and the backplate 105. Both dots should be higher than half the distance between the two plates and should be aligned with each other during assembly. As the parts are assembled, the two epoxy dots join together and amalgamate to form the electrical connection (FIG. 11B).

FIG. 12 shows another method of making electrical contact. The backplate 105 is lanced to provide a lead 823 to reach the PCB 106. An electrically conductive epoxy dot 824 completes the contact. This lead is relatively stiff and should be shorter than the distance between the two parts.

Figure 13:
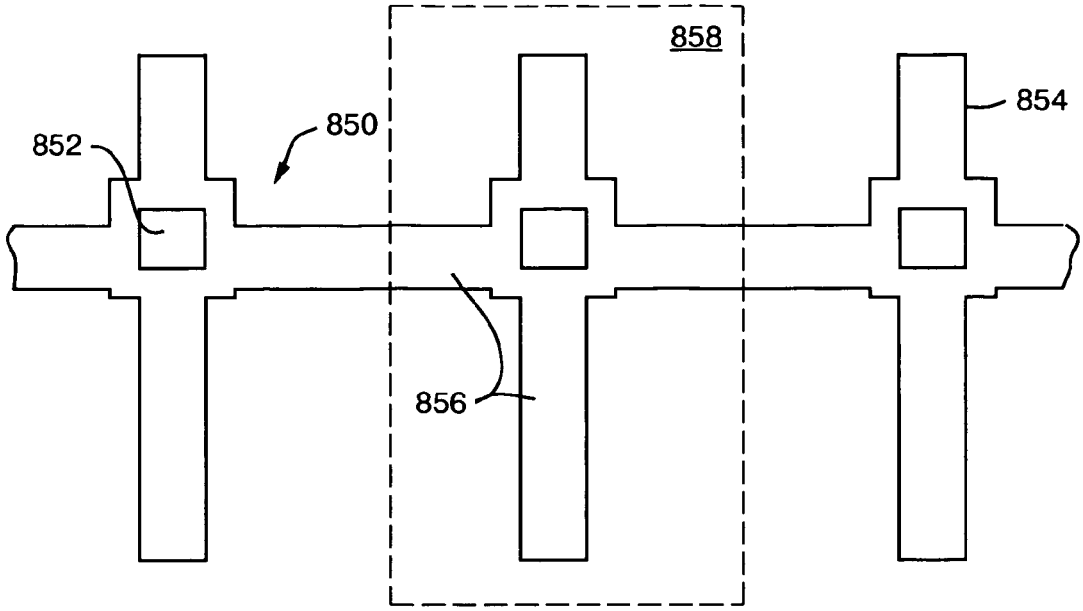
FIG. 13 a plan view of an array of connections.
Figure 14A:
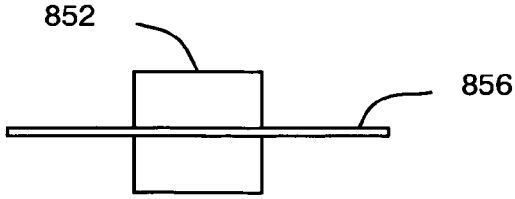
FIGS. 14A, 14B and 14C illustrate a process for making a plurality of alternate type electrical connections from the array of FIG. 13.
Figure 14B:
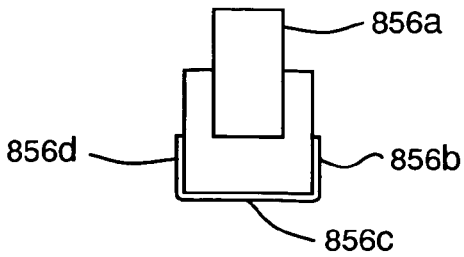
Figure 14C:
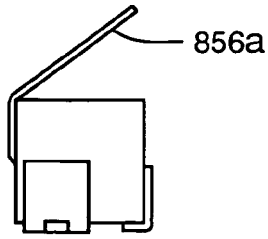

FIG. 13 show a plurality of contacts in an array 854 that resembles a small surface mount plastic package. Small plastic cubes 852 are preferably injection molded onto a sheet metal frame array 854, including suitable electrically conductive leads 856. When each section 858 (shown in dotted lines) is separated, there are four leads 856 protruding from each of four sides of the cube 852. As shown in FIGS. 14A and 14B, three of these leads 856B, C and D are bent around one face of the cube 852 to form three solder pads. The fourth lead 856A is bent at an angle, as shown in FIG. 14C to become the spring contact connection to the backplate. This embodiment allows the lead connection to be placed and soldered on the PCB 106 with standard assembly equipment and processes. The lead 856A that contacts the backplate 105 provide a pressure contact or a conductive epoxy contact can be applied to retain the lead in place. The material for the plastic and the electrically conductive leads are well known and may be chosen suitably by one skilled in the art.

Figure 15A:
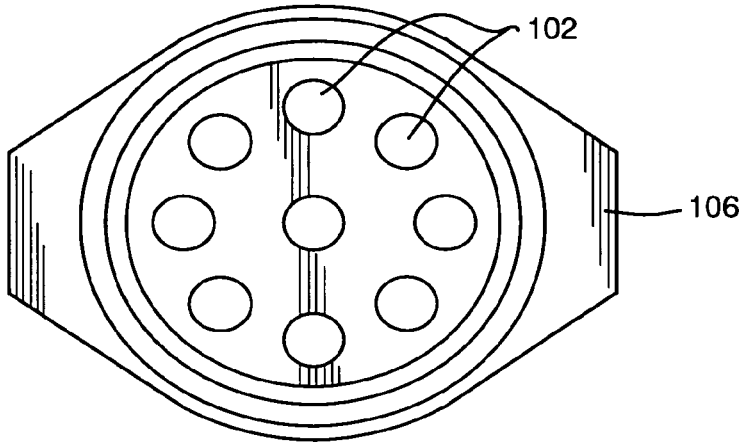
FIG. 15A is a top plan view of the microphone assembly of FIG. 15B.
Figure 15B:
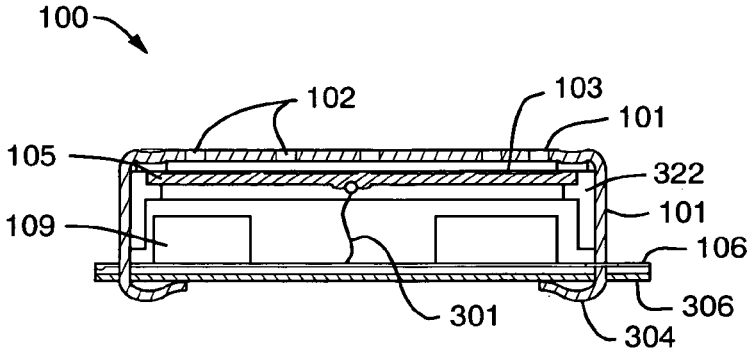
FIG. 15B is a side view of another embodiment of a microphone assembly.
Figure 15C:
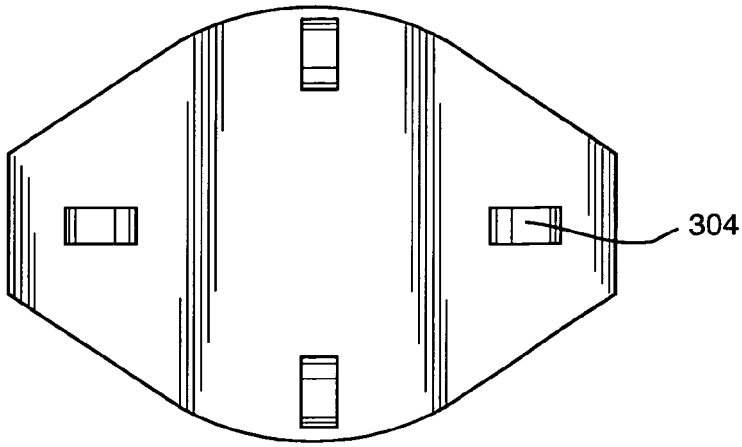
FIG. 15C is a bottom view of FIG. 15B.
Figure 16A:
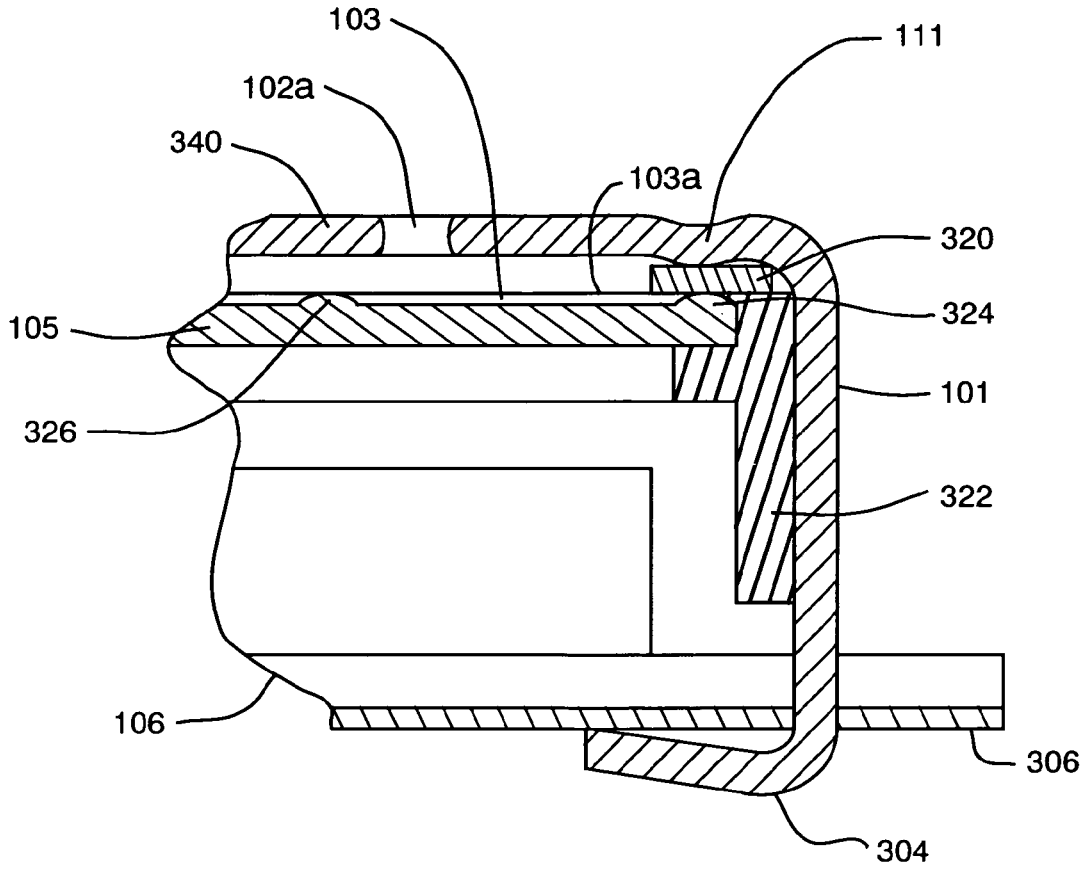
FIG. 16A is an enlarged partial view of a portion of FIG. 15A.
Figure 16C:
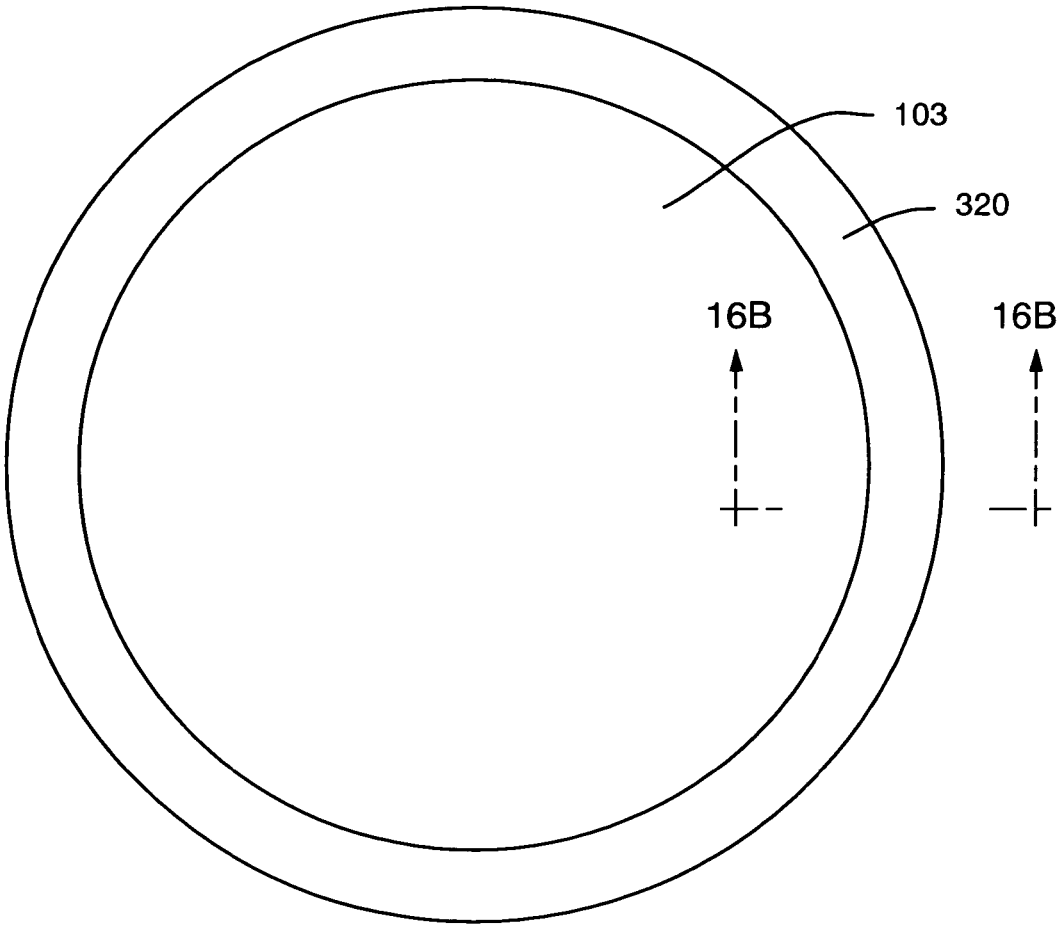
FIG. 16C is a top view of the diaphragm 103 and support frame 320 of FIG. 15B.

Further details of the hearing aid microphone assembly described in FIG. 8 will now be provided in connection with FIGS. 15–18. The basic parts of the assembly are the diaphragm 103, the backplate 105 and the housing 101. In addition, spacers as will be described, are provided to maintain the proper relationship of the parts. All of these parts are fastened to a circuit board 106 that contains all of the necessary electronics for the hearing aid. The cross-section of FIG. 15B shows the relationship of all the parts. FIGS. 15A and 15C are top and bottom views respectively. FIG. 15A shows a series of holes 102 to allow sound to reach the diaphragm. The bottom view, FIG. 15C, shows tabs 304, which are part of the housing, wrapped around the PCB 106 to clamp the housing 101 tightly to the circuit board. These tabs make electrical connection to the PCB ground plane 306 that covers the entire bottom of the PCB 106. The tabs must be wrapped tight enough to insure that there is a good acoustic seal between the housing 101 and the top of the PCB. A soft coating (not shown) may be sprayed onto the top surface of the circuit board before installing the housing to insure a good seal. FIG. 16 shows a partial enlargement of one end of the cross section of FIG. 15B to show more detail of the relationship of the internal parts.

Figure 16B:
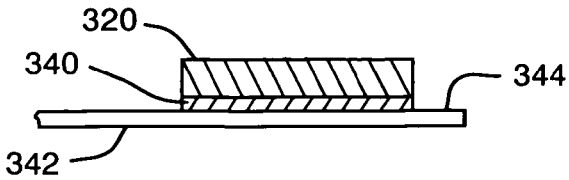
FIG. 16B is an enlarged partial section of a portion of FIG. 15B showing the details of the diaphragm 103 and support frame 320.
Figure 17B:
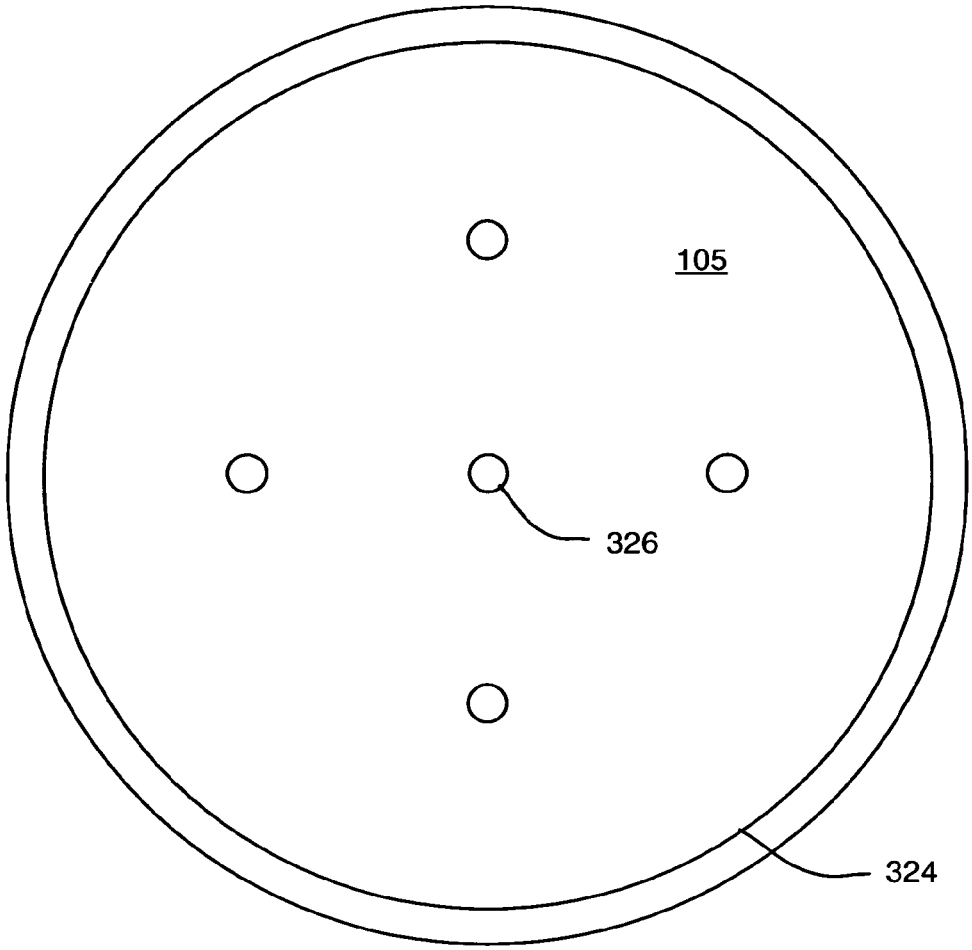
FIG. 17B is a top plan view of FIG. 17A.
Figure 17A:
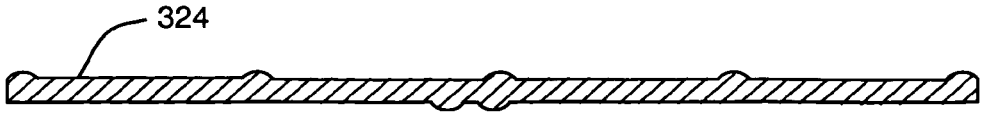
FIG. 17A is a sectional view of the backplate 324 of FIG. 16B.

The diaphragm 103 shown in detail in FIGS. 16 and 17 is constructed of an extremely thin stretched metal coated dielectric film 342, for example, 0.001" thick Teflon® covered with a metal coating 344 on one side 103A. The film is stretched and adhered to an annular conductive support frame 320 using a conductive adhesive 340 (see FIG. 16B). The conductive side of the film 103A should make good electrical contact with the frame 320. The diaphragm and frame assembly is placed into the housing so that the frame 320 contacts the housing at the raised ring spacer 111 which is coined into the planar top portion of the housing to establish the desired spacing between the diaphragm and the housing. Before assembly, a static charge is placed on the diaphragm film 103. The charge can be placed onto the diaphragm 103 (or onto a Teflon® coating on the backplate 105) by one of several methods such as corona discharge or ion-beam deposition. It is also possible that the frame 320 can be adhered to the opposite side of the film 342 so the conductive side of the film contacts the housing directly. Then, the adhesive does not have to be conductive.

The backplate 105 shown in FIG. 16A must be located extremely close to the diaphragm 103. Note: Unlike previous embodiments, no separate spacer 501 is used between the diaphragm and the backplate. Instead, a small ridge 324 is coined on the edge of the backplate. When the backplate is placed into the housing, the ridge presses against the frame 320 of the diaphragm to establish a space 104 that, for example, may be 50 microns. This diaphragm is much larger in diameter than is used in present day production. Therefore, the diaphragm 103 can be unstable when the bias voltage is applied. To break up the large unstable area, small projections 326 are coined into the backplate to support the center of the diaphragm the proper distance from the backplate. A bias voltage is provided to keep the diaphragm tight against the projections 326.

Figure 18C:
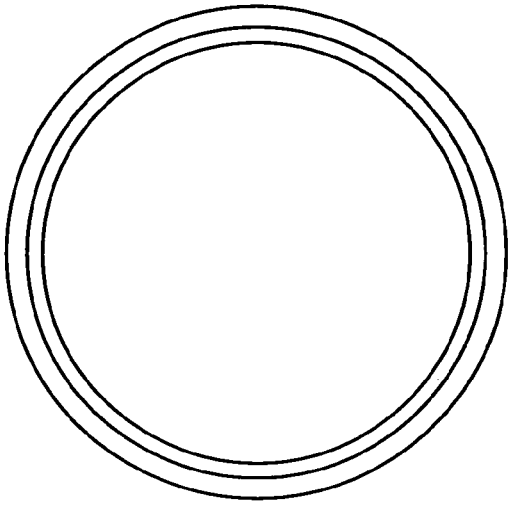
FIG. 18A is a top plan view of the mounting ring 322.
FIG. 18B is a side view of the mounting ring 322.
FIG. 18 is a bottom plan view of the mounting ring 322.
Figure 18B:
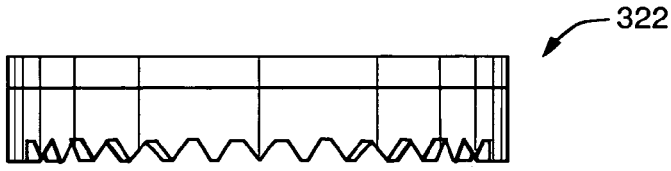
Figure 18A:
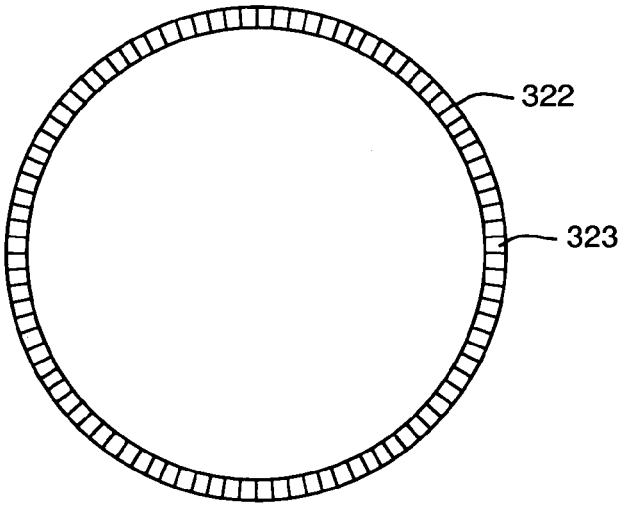

An insulated mounting ring 322 shown in detail in FIGS. 18A, 18B and 18C is provided to support the backplate 105 and clamp the backplate diaphragm frame 320, and housing 101 together. An outer peripheral edge of the mounting ring 322 is shown with a plurality of small weak projections 323 that will easily collapse when all of the parts are clamped onto the circuit board. An alternative method of clamping the parts together is to press fit the ring into the housing to hold the parts together. Then, four or more indentations are punched into the sides of the ring for a more permanent anchor. Tight tolerances for the press fit parts can be relieved by molding ribs (not shown) into the side of the ring. The ribs will easily collapse during the press fit operation.

The housing and its assembled parts are fastened to the circuit board by 4 or more tabs 304 that penetrate slots in the circuit board (FIG. 16A). While the sandwich of parts is clamped tightly, the tabs are bent onto the copper layer 306 on the back of the circuit board. The copper layer and the metal housing make a shield for the circuit inside. This embodiment requires no solder adhesives, or welding for the final assembly.

As noted, the microphone assembly and electronics described above is intended to be part of a disposable, i.e., " throw a way" hearing aid. It does not have to survive inventory plus 8 or more years of life. It is adapted to last 2 years in an inert atmosphere package plus 40 days in use.

Although the drawings show a circular microphone, any reasonable shape can be used. For example, there can be flats on the sides of the housing so that the housing is more form fitting to the internal circuit consisting of rectangular components. The advantage of this design is that volume allocated to exterior contacts and a switch is almost doubled. These flats will also serve as orientation and gripping surfaces for automation equipment. Because of the rectangular shape of the circuit components, four flats can be formed on the sides of the housing, if needed, for automation purposes.

The advantages of this embodiment are:

1. All of the metal parts can be manufactured similar to picture tube gun parts that are very low cost and with high tolerances.
2. Almost the entire diaphragm is active.
3. Coined features insure very accurate spacing and location of all the parts.
4. No solder, welding, or gluing is needed at final assembly. The diaphragm and frame are delivered to the line as a subassembly.
5. True layered assembly.
6. The flat sides of the housing allow room for test points, connection pads, and a switch.

Another important feature of the invention shown in FIGS. 15A, 15B and 15C involves the sound openings. Most persons with hearing loss have greater high frequency hearing loss than low or mid-frequency hearing loss. This causes such persons to miss or confuse softly spoken, low energy consonants such as t, b, v, k, p, s. Thus, one function of an appropriate hearing aid is to amplify high frequency energy sufficiently to make these low level sounds audible and at a comfortable listening level. The sound inlet for a hearing aid microphone typically is very narrow. When high frequency sounds from outside the hearing aid pass through this narrow opening, they are attenuated by inertance and acoustic resistance, resulting in a lower high frequency input to the hearing aid than desired, and possibly reduced audibility to important high frequency speech sounds. Additionally, too small an inlet may produce an acoustical resonance in the microphone system frequency response (as used in the hearing aid). Wind turbulence passing across and down the small cylindrical-shaped microphone inlet vibrates the microphone diaphragm, which results in a noise that interferes with the desired hearing aid operation.

The hearing aid microphone assembly 100 shown in FIGS. 15A, 15B ad 15C has a very large microphone diaphragm 103 interfacing with multiple inlet holes 102 through the a housing 101. Alternatively, the housing 101 may be further contained in an enclosure 408 (as shown in FIG. 4) which also has multiple inlet holes 409, in faceplate 406 in which case the diaphragm 103 may be fully exposed to the exterior faceplate with a single large aperture 102B provided at the end face of the housing 101. In the latter case, using more than one sound inlet hole in the enclosure effectively minimizes inertance and acoustic resistance and ensures that the aggregate sound inlet has a minimal effect on the acoustic response of the microphone system. If the combined area of the holes is large enough, the acoustic impedance will be very low. The holes in the faceplate 406 should be made as large as possible without allowing a wearer to insert pins through them. A 0.040" diameter hole or smaller is desirable. The narrower and longer the holes, the more are needed. Flaring the outside and/or inside surfaces of the microphone sound inlet holes (see 102A FIG.

16A or openings 409 of FIG. 4) helps to reduce the turbulence produced by wind, and hence, wind-induced noises.

In another embodiment of the invention, a vibration isolation material, such as a thin piece of acoustically transparent felt 163 is placed between the metal housing 101 of the microphone assembly 100 and the enclosure 408 (see FIG. 4). The felt 163 will damp mechanical vibrations produced by the hearing aid receiver conducted through the shell and transduced by the microphone. In addition, the felt will protect the microphone diaphragm from foreign objects.

Figure 19A:
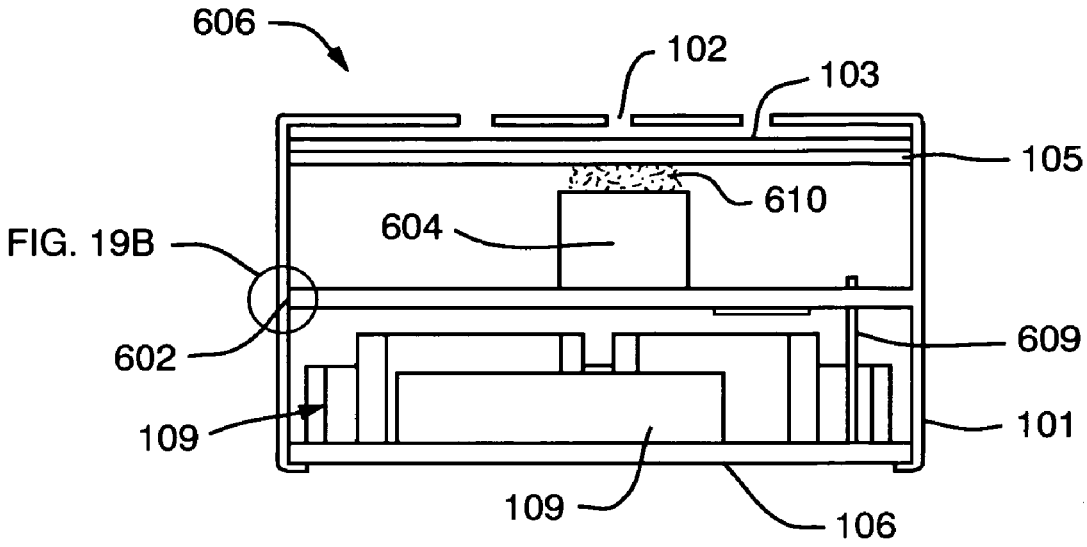
FIG. 19A is a schematic side view of another embodiment of a microphone and electronic assembly housing of the invention which includes an intermediate PCB shield between the microphone and a JFET to form a separate compartment from the other electronics mounted on a second PCB.

FIG. 19A illustrates in schematic form another embodiment of the invention. In the previous embodiments, the printed circuit board 106 provided an acoustical seal for the rear volume of the microphone, i.e., diaphragm 103/backplate 105. The electronic circuitry of the hearing aid was mounted on the printed circuit board 106. In that embodiment, it is possible that signals from the electronics may be coupled to the backplate electrode of the microphone through parasitic capacitance. The invention disclosed in this embodiment provides an electrostatic shield 602 to prevent electromagnetic interference (EMI) between the electronics 109 and the back-plate electrode 105 as well as providing a shielded compartment for a high input impedance amplifier 604 used in conjunction with the electret microphone element.

In FIG. 19A an electret microphone is disposed in housing 101 having sound openings 102 located opposite diaphragm 103, and backplate electrode 105. Also shown is a substrate/shield 602 extending across the inner sides of housing 101, an amplifier 604, mounted to the substrate 602, and an electrical connection 609 between the substrate/shield and the main PCB, wherein the PCB 106 contains the main electronic components of the hearing aid electronics.

Hearing aid electronics 109 may include class-D switching amplifiers, switched-capacitor filters, or digital electronics, such as one commonly found in digital signal processing circuits. Each of these type of circuits contain signals switching at high frequencies which may be coupled to the microphone diaphragm or backplate through parasitic capacitances. These high frequencies would, thereby, introduce noise into the microphone signal and possibly effect the operation of the circuit. The substrate/shield 602 contains at least two layers of metallization 602A and 602B, wherein one layer is primarily a ground plane and functions to shield the microphone elements from the high frequency signals in the hearing aid electronics.

Some of the benefits of this embodiment are as follows:

1. Inherent electrical shielding is provided by the combination of the metal housing 101 and the power and/or ground plane(s) 602A/B on the substrate/shield 602.
2. Allows the use of various types of JFET, BICMOS, or low-noise CMOS amplifiers 604 mounted on said substrate.
3. The substrate/shield 602 provides shielding between the amplifier 604 mounted thereon and the hearing aid electronics 109 mounted on the printed circuit board 106.

In the invention described in connection with FIG. 19, the amplifier 604 is mounted on one PCB 602 and the hearing aid electronics are mounted on a second PCB 106. FIG. 20 shows an alternate embodiment in which all components (amplifier and hearing aid electronics) are mounted on one PCB 602.

Figure 20:
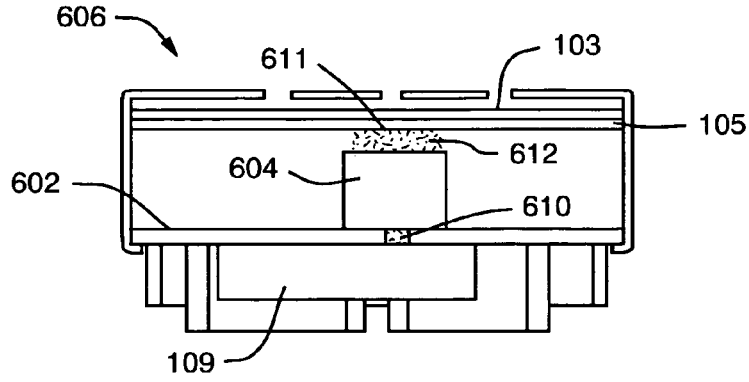
FIG. 20 is a schematic side view of a microphone and electronic assembly housing of another embodiment of the invention which includes a single PCB shield between the microphone and a JFET mounted on the shield PCB wherein the remaining electronics are suspended from the shield PCB.
Figure 21:
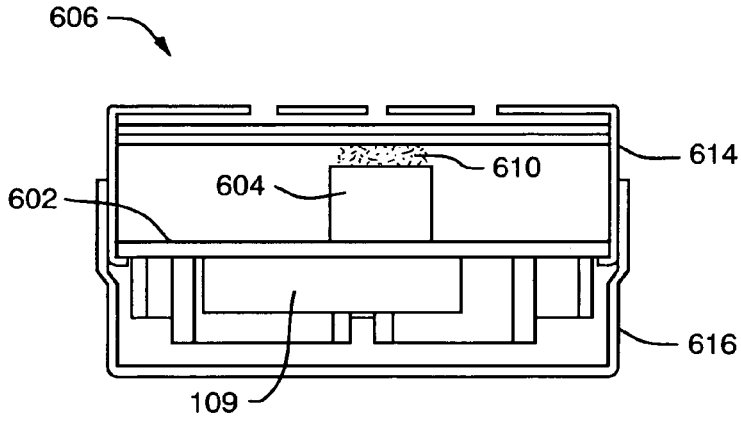
FIG. 21 is an assembly as in FIG. 20 wherein the suspended electronics are enclosed in a second metallic housing connected to the microphone housing.

FIG. 21 shows an optional shielding cover for the FIG. 20 embodiment that provides EMI shielding for the electronics.

Figure 19B:
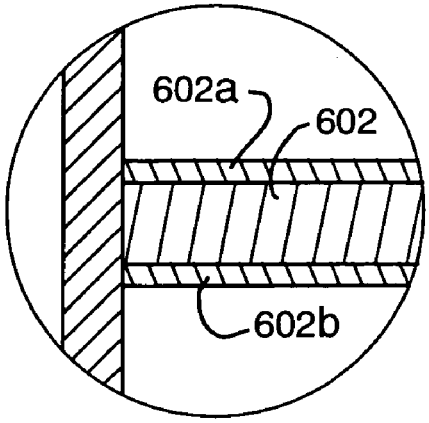
FIG. 19B is an enlarged view of a circled portion of FIG. 19A.

Note that FIGS. 19–21 show an amplifier, preferably a JFET amplifier, that has been mounted to the printed circuit board using flip-chip technology. Conductive epoxy 610 connects the gate of the JFET 604 to the backplate 105 of the electret microphone shown generally at 606.

As noted, in the embodiment of FIG. 19A, one PCB is required for the JFET that serves as a buffer amplifier 604 for the electret microphone element and one PCB 106 for the hearing aid amplifier in the electronics 109. The result is a relatively large and expensive microphone/amplifier assembly. One reason for separating the microphone from the IC amplifier in the electronics 109 is that microphone output signals from buffer amplifier 604 are low level, whereas IC amplifier output signals are 40–50 dB higher in level. If the amplifier output signal gets back into the microphone output signal, the audio signal processing performance may significantly degrade. Additionally, the microphone/amplifier assembly 606 must have shielding from external EMI signals such as digital wireless telephone interference sufficient for a hearing aid wearer to use a digital cellular telephone. This has been accomplished as disclosed previously by enclosure of the entire microphone/amplifier assembly in a metal can or housing 101 which is grounded to the ground plane of PCB 106.

By making the PC board 602 such that components are mounted on two sides (as in FIG. 20) rather than one side, the JFET buffer amplifier 604 can be placed on one side (the same side as the microphone element) and the amplifier IC and external components 109 can be placed on the other side of the same PCB 602 (FIG. 20). The pre-amp (not shown) in the amplifier IC connects to the JFET through a via connection 612 in the PCB 602. Metallization 611 on the JFET connects with conductive epoxy 610 to the backplate 105 of the microphone 606. This results in a smaller and less expensive microphone/amplifier assembly, while isolating the high level output of the IC amplifier from the low level microphone output via the ground plane shield layer 602B incorporated in the PCB 602. EMI shielding can be retained by placing a second metal can 616 over the amplifier IC and external components 109 on the bottom of the PCB 602. FIG. 21 shows such an overlapping configuration of top 614 and bottom 616 metal shield cans with respect to the printed circuit board. Other configurations are possible as well such as butting the two cans together and joining them with conductive epoxy.

As previously noted, an electret microphone for hearing aids typically uses a JFET buffer to convert the signal from the backplate a high impedance source (the microphone) to a low impedance source. This impedance conversion results in a higher level loaded output signal level to the hearing aid amplifier than would be produced from the condenser microphone element itself without a buffer. A JFET gate contact to the backplate of the microphone's condenser must somehow be made. A direct connection from a 4 mil square pad on the JFET to the microphone backplate is difficult to do and the use of an intermediate wire bond pad requires that the pad be mounted on ceramic, which complicates assembly. If the JFET gate connection is on the substrate, the substrate must have high resistivity to not compromise the input impedance of the amplifier. A ceramic (alumina) substrate has such properties. Traditionally, the electrical connections for the JFET have been wire bonded to the microphone element onto a ceramic substrate. Wire bonds are normally formed with a loop from pads on the die to extra bonding pads on the ceramic substrate, a practice that requires extra space vertically and horizontally and produces stray capacitance to ground and other circuit nodes which reduce sensitivity and introduce noise. Other disadvantages of a ceramic substrate itself are that it is relatively costly for use in a disposable hearing aid application and that it has a high dielectric constant which makes stray capacitance even higher.

Figure 22:
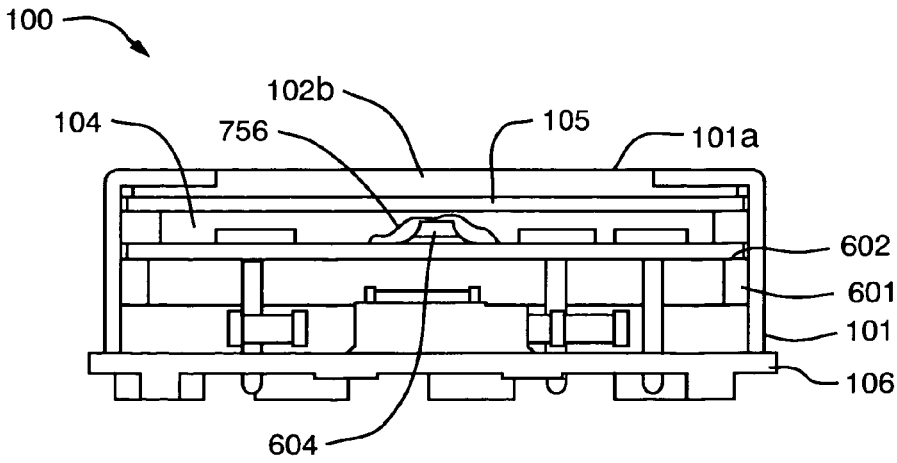
FIG. 22 is a schematic side view of a microphone assembly in which a JFET buffer is provided with source/drain flip-chip pads and a backside gate that is fastened to the microphone backplate.
Figure 23A:
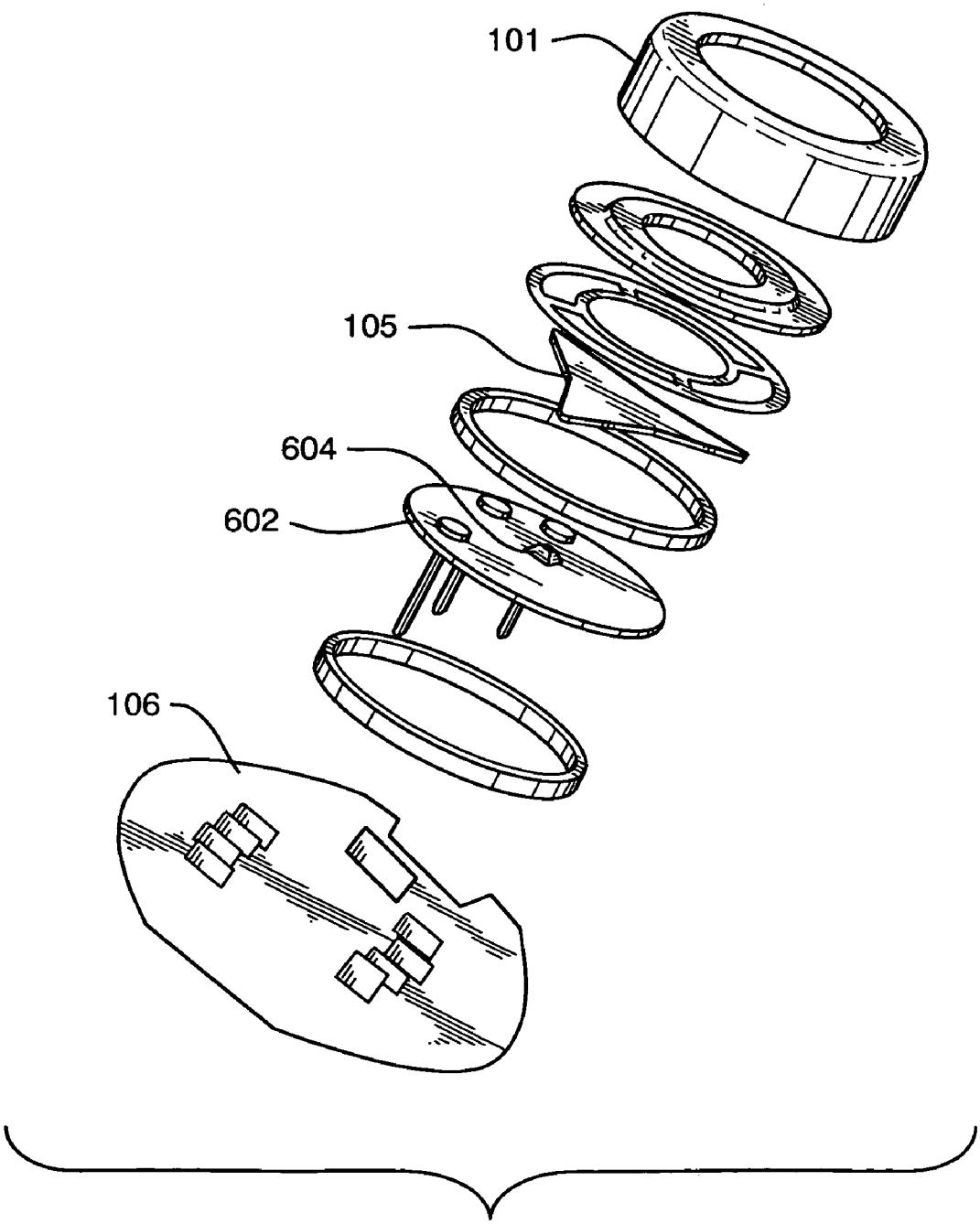
FIG. 23A is an exploded view of the assembly of FIG. 22.

In accordance with the embodiment shown in FIGS. 22 and 23A, B and C, flip chip technology is used to minimize the physical size and lead lengths required to connect die bond pads of the JFET 604 to reduce the lead length between the electret microphone backplate 105 and the JFET. The result is a lower noise and higher sensitivity connection than could be made by longer paths formed by conventional wiring. By keeping the JFET backside gate connection 762 of the FET off the PCB 602 substrate 764, a lower cost substrate such as a glass-epoxy printed circuit board (e.g., FR4) may be used. Since the JFET gate does not contact the substrate and then connect to the microphone backplate (rather the JFET is connected to the backplate directly), the stray capacitance should be lower and, hence, sensitivity should be higher.

Figure 23C:
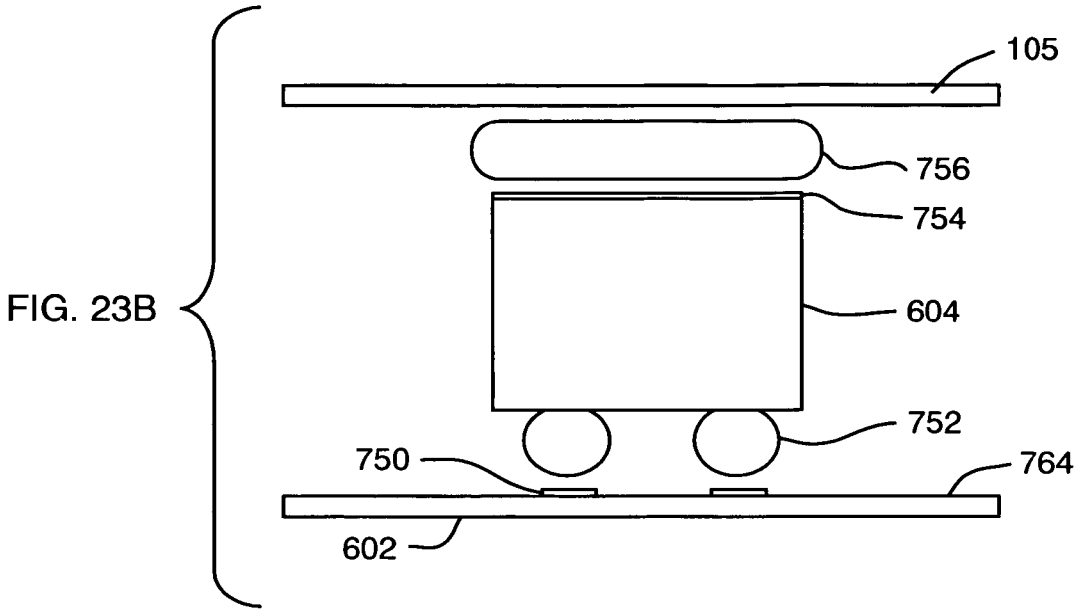
FIG. 23C is a detail as in FIG. 23B after assembly.
Figure 23C:
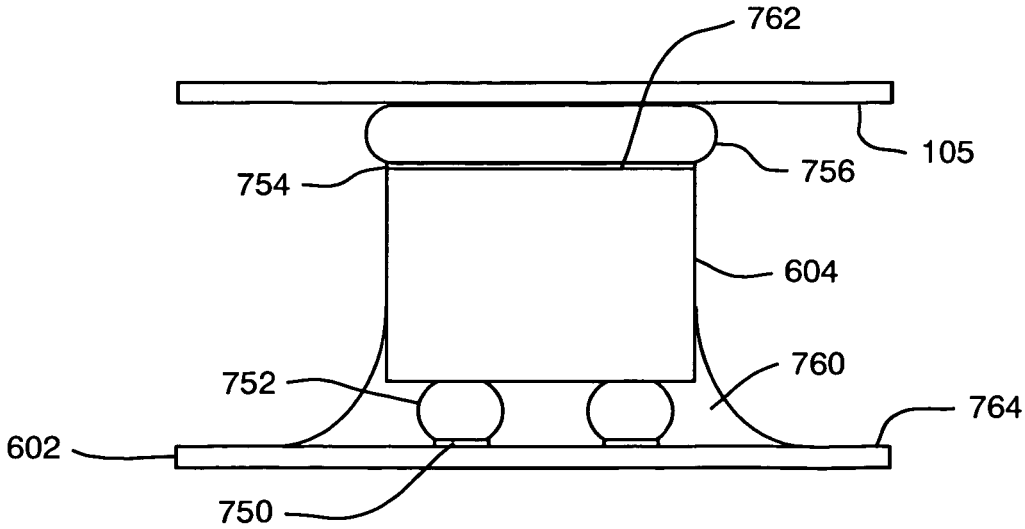

FIGS. 23B and 23C show details of the flip-chip JFET connections including the gate to backplate connection 762 using conductive epoxy 756. FIG. 23B is an exploded view before assembly, while FIG. 23C shows the JFET after assembly with the PCB 602 and the backplate 105. The metallization 754 on the top of the JFET die 604 is the gate connection, which is a very high impedance point. The solder bumps 752 on the bottom are the low impedance connections such as the drain and source connections. In this embodiment of the invention, four solder bumps: Drain, Source, Bias, and one dummy solder bump that is a No-Connect (NC) are provided. NC is not connected to any part of the JFET circuit. The underfill material 760 provides mechanical support.

This embodiment of the invention produces the following advantages:

a. A flip-chip JFET 604 with no gate contact made to the PCB, allows use of low cost FR4 or other such materials instead of ceramic for the PCB substrate.
b. By controlling the depth of the front chamber 104 in the microphone assembly so that the spacing from the backplate to the PCB substrate is small enough, a single blob of conductive cement 756 is sufficient to bridge the gap, eliminating the need for wire bonds.
c. Stray capacitance from the gate to PCB substrate is reduced because of this gate isolation, resulting in decreased signal loss and decreased noise pickup.
d. The use of four dummy solder balls on JFET to provide better mechanical support and alignment during assembly. (Solder bumps on Drain, Source, Diode, and NC solder bumps 752).

Figure 24:
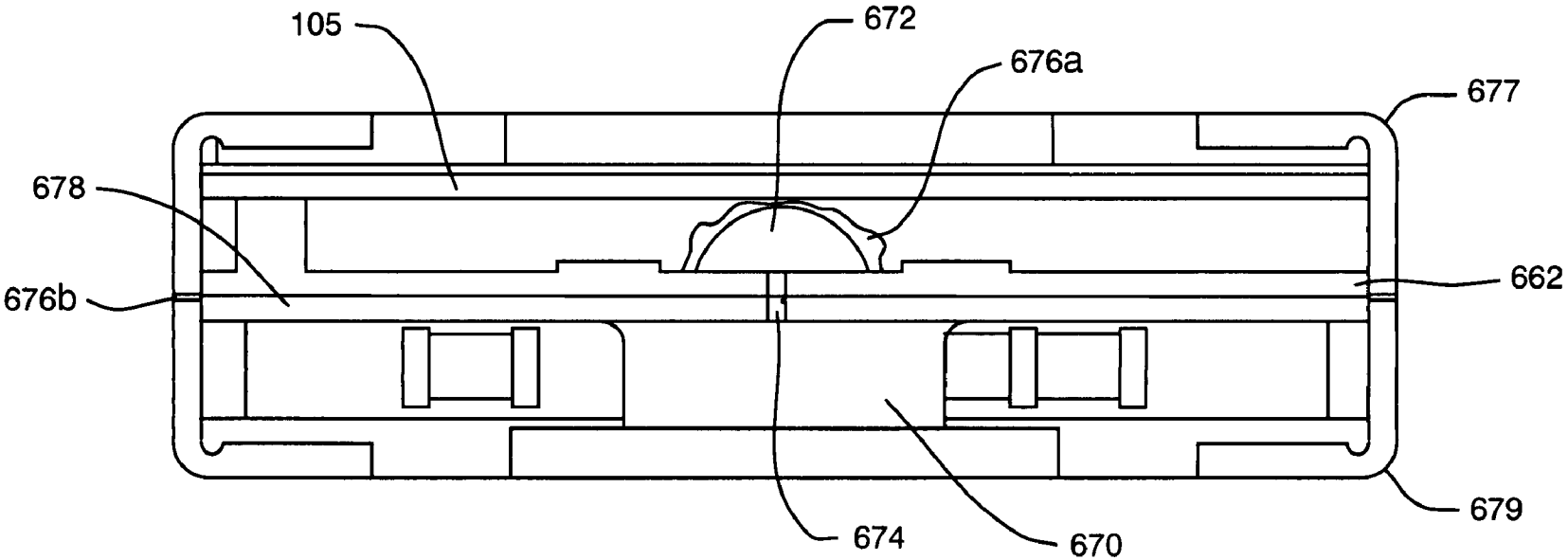
FIG. 24 is a cross-sectional view of an EMI shielded microphone assembly in which the JFET function is included in an IC on the PCB.

FIG. 24 illustrates yet another embodiment of the invention comprising a reduced component count EMI shielded microphone/amplifier assembly for use in disposable hearing aid in which the JFET buffer function is incorporated in a hearing aid amplifier integrated circuit disposed on the bottom of PCB.

Previous embodiments required one printed circuit board for the JFET that serves as a buffer for the electret microphone element and one PC board for the hearing aid amplifier (e.g., FIG. 19). Without the JFET function, the microphone element output is a high impedance and low signal level. The JFET produces a low impedance/higher signal level microphone output. The result is a relatively large and expensive microphone/amplifier assembly. Another reason for separating the microphone from the amplifier and buffering its output with a JFET is that microphone output signals are low level loaded whereas amplifier output signals are 40–50 dB higher in level. If the amplifier output signal gets back into the microphone output signal, the audio signal processing performance may significantly degrade. Additionally, the microphone JFET amplifier assembly in the previous embodiments must have shielding from external EMI signals such as digital wireless telephone interference sufficient for a hearing aid wearer to use a digital cellular telephone. This has been accomplished and disclosed previously by an encapsulation of the entire microphone/amplifier assembly in a metal can.

In accordance with the embodiment of FIG. 24, the external JFET is eliminated by providing its impedance transforming functions within an amplifier integrated circuit 670 mounted on the bottom side of PCB 602. Then, the two-sided PCB 602 is provided with a metal bump 672 (in place of the JFET) of previous embodiments, on one side (i.e., the same side as the microphone element) and the amplifier IC 670 and external components are placed on the other side of the PCB. A pre-amp in the amplifier IC 670 connects to the metal bump through a via connection 674 in the PCB. The metal bump connects with conductive epoxy 676A to the backplate of the microphone. This results in a smaller and less expensive microphone assembly. A ground plane shield layer 678 is incorporated in the PC board. EMI shielding is retained by placing a second metal can 679 over the amplifier IC and external components on the bottom of the PCB 602 and joining can 679 with upper can 677 using conductive epoxy 676B at the joints. Alternately, the two cans may be soldered, welded, or press fit together to make the electrical connection.

Further details of the invention will now be described in connection with FIGS. 25–27 which relate to improvements in sensitivity of capacitor microphones such as electret microphones commonly used in hearing aids. Traditional hearing aids use small microphones, generally of the electret type. These traditional microphones have sensitivities of about −35 dB (re: 1V/Pa). At a sound pressure level of 94 dBSPL (re: 20 $\mu$Pa), the output voltage of such microphones is about 17.8 mVrms (50 mVpp). Larger diaphragm microphones may achieve a sensitivity as high as about −15 dB (re: 1 V/Pa), or 178 mVrms (503 mVPP) at 94 dBSPL. Those skilled in the art of hearing aid design must make a tradeoff between system noise performance and signal overload. Those using a high sensitivity microphone or an expensive low-noise amplifier to increase the microphone signal above the noise floor of the remaining circuitry must risk signal overload for loud sounds, or accept poorer noise performance but have large headroom to prevent overload from loud sounds. To obtain the best of both worlds, some hearing aids include an input amplifier with input compression limiting. This amplifier has a gain of about 20 dB for low-level signals. However, for signals greater than about 90 dBSPL, the gain of the amplifier is reduced to prevent signal overload and distortion. The amplifier must be built from a low-noise semiconductor process so the amplifier itself does not introduce excessive noise into the system. In accordance with this embodiment of the invention, a microphone with higher inherent sensitivity is provided along with means to reduce the sensitivity for loud sounds. The higher sensitivity eliminates the need for an expensive low-noise amplifier, and hence total system costs will be reduced. The invention disclosed herein may be applied to capacitor microphones used in other than hearing aid applications. For example, electret microphones are commonly used in telephones, answering machines, portable tape recorders, and cellular telephones. Each of these applications generally uses some form of automatic gain control or compression limiting to prevent overload and distortion from large signals.

Most hearing aid microphones are small and hence use small diaphragms. In a previous embodiment, a large diaphragm microphone is disclosed. The large diaphragm microphone provides both a lower noise and higher sensitivity compared to traditional microphones. However, the higher sensitivity means that the hearing aid will overload and distort at lower sound pressure levels than traditional microphones.

Figure 25:
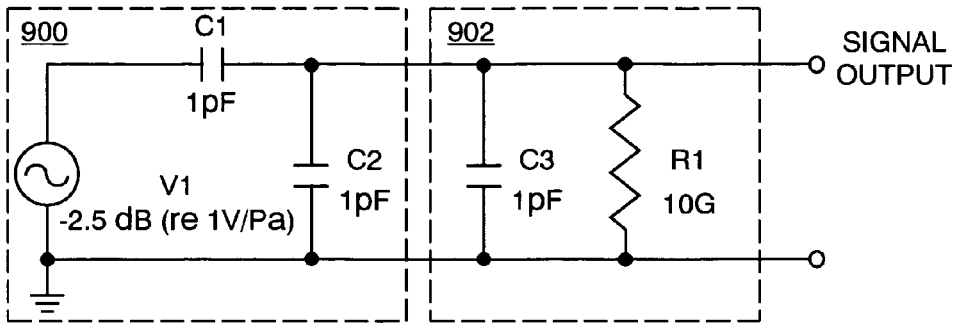
FIG. 25 (PRIOR ART)
FIG. 25 is an equivalent circuit of a prior art microphone.

FIG. 25 shows an equivalent circuit of a traditional microphone 900. The voltage source V1 produces a voltage proportional to sound pressure level. Capacitors C1 and C2 are the active capacitance and parasitic capacitance of the microphone, respectively. Capacitor C3 and resistor R1 represent the input impedance of the electronics circuitry 902 that the microphone element drives. One skilled in the art can easily see that the components $C_1$–$C_3$ and R1 form a voltage divider that effects the effective sensitivity of the microphone.

Figure 26:
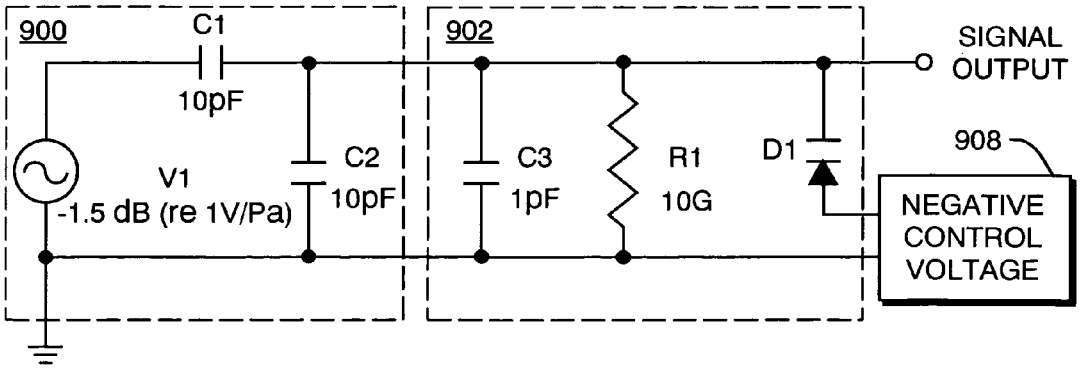
FIG. 26 is an equivalent circuit of one embodiment of an improved microphone of the invention having sensitivity control capability.

FIG. 26 shows an equivalent circuit of a large diaphragm microphone of the invention driving electronics that include a variable capacitance diode (D1). Components C1—C3, R1 and the capacitance of D1 form a voltage divider that effects the effective sensitivity of the microphone. With the connection of D1 between the signal output and a control voltage 908, a negative control voltage may be applied to the anode of D1 to vary its capacitance. By varying the control voltage, the voltage divider is controlled and hence the effective sensitivity of the microphone 904 is controlled. The capacitance of variable capacitance diodes, such as Philips Semiconductor part BB130, can be varied from about 16 pF at a reverse voltage of 28V, up to about 500 pF at a reverse voltage of 1 V. With the values of $C_1$–$C_3$ shown in Table II below, the sensitivity of the microphone can be varied over a 23 dB range. However, the reverse voltage of up to 28 V is much higher than is practical for hearing aid circuits which are intended for operation from a 1.3 V battery source.

TABLE II

| COMPONENT | CAPACITANCE |
|---|---|
| C1 | 10 pf |
| C2 | 10 pf |
| C3 | 1.0 pf |

Figure 27:
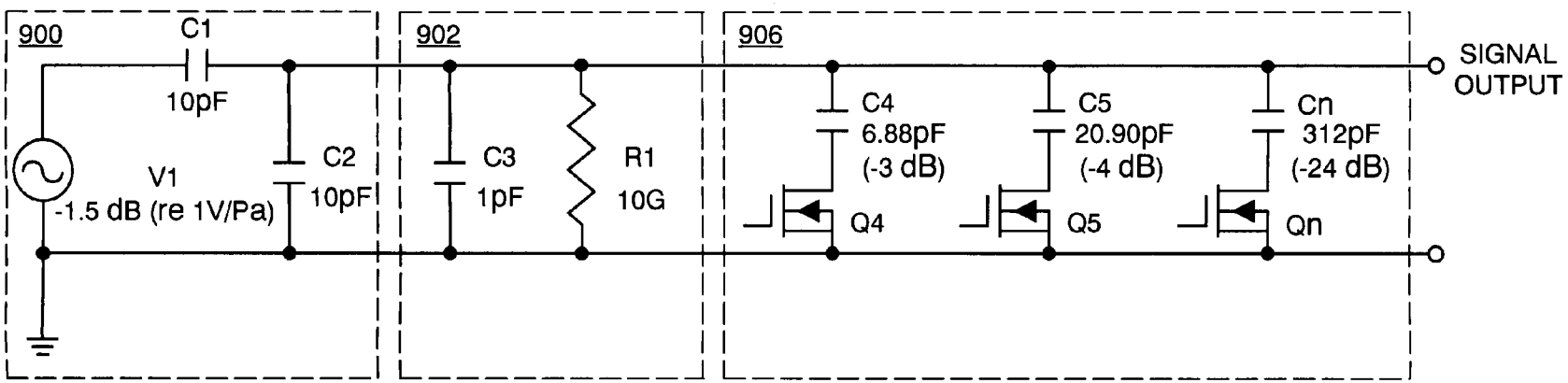
FIG. 27 is an equivalent circuit of an alternate embodiment of the improved microphone of the invention having sensitivity control capability.

Another embodiment of the invention is shown in FIG. 27. In FIG. 27, the variable capacitance diode of FIG. 26 has been replaced with a series of capacitors (C4–Cn) and transistors (Q4–Qn) shown here as MOSFET type transistors forming a variable sensitivity circuit 906. The transistors act as switches. Any number of capacitor/transistor pairs may be used. With all transistors turned off, the microphone sensitivity is at its maximum. As capacitor/transistor pairs are turned on, the voltage divider is changed and the effective sensitivity of the microphone is reduced. With reference to FIG. 27, the values of C4–Cn may be selected to provide attenuation steps of any value desired. Typical step values may be from about 1 dB to about 6 dB and preferably from about 1 to 3 dB. Other series/parallel combinations of switched capacitors can be used to implement digitally controlled sensitivity adjustment of the microphone.

Some of the benefits/features of the invention disclosed herein are:

1. Large output signal from microphone results in lower system noise.
2. Electronic control of microphone sensitivity prevents overload and distortion at high sound pressure levels.
3. A low noise gain controlled amplifier is not needed.
4. The use of a standard CMOS process is allowed, rather than more expensive JFET, BICMOS, or low noise CMOS processes for the input amplifier of the electronics, resulting in lower system costs.

Hearing aid microphones of the electret type typically produce an output signal which is amplified by a junction field-effect transistor (JFET) amplifier. Such hearing aids are powered by a single zinc-air cell that produces about 1.3 volts. Electrical noise on the 1.3 volt power is reduced by a resistor-capacitor filter, or by an active voltage regulator. In either case, the final dc voltage available for the JFET amplifier circuit is about 0.90 to 0.95 volts. This low voltage imposes tight tolerances on the JFET device parameters, in particular on the pinch-off voltage parameter. Therefore, the yield of the JFET devices is low and the costs are relatively high. In previous embodiments of the invention, the microphone element is generally of the electret type and the amplifier is of the JFET type and is located within the cover of the microphone. The main electronics are mounted on a PCB in the microphone housing and the remainder of the electronics in the hearing aid enclosure. The remaining electronics include a separate battery and a receiver which may be either a passive receiver or one containing an integral class-D amplifier. Microphones and receivers of these types are commercially available from several source including Knowles Electronics, Inc. (Itasca, Ill.), Microtronic A/S (Roskilde, Denmark), and Tibbetts Industries (Camden, Me.). In general, the commercially available microphones are intended to operate on a voltage of about 0.9 volts to 1.5 volts, and generally are operated at about 0.9 volts to 0.95 volts.

The embodiments shown in FIGS. 28–31 provides a supplemental power source for the microphone JFET amplifier per se which is integral to the microphone housing and free of noise from the main power source in the hearing aid. It provides higher operating voltages for the JFET amplifier so that the tight tolerances of the JFET parameters are no longer necessary, and the cost of the JFET may be reduced.

Figure 28:
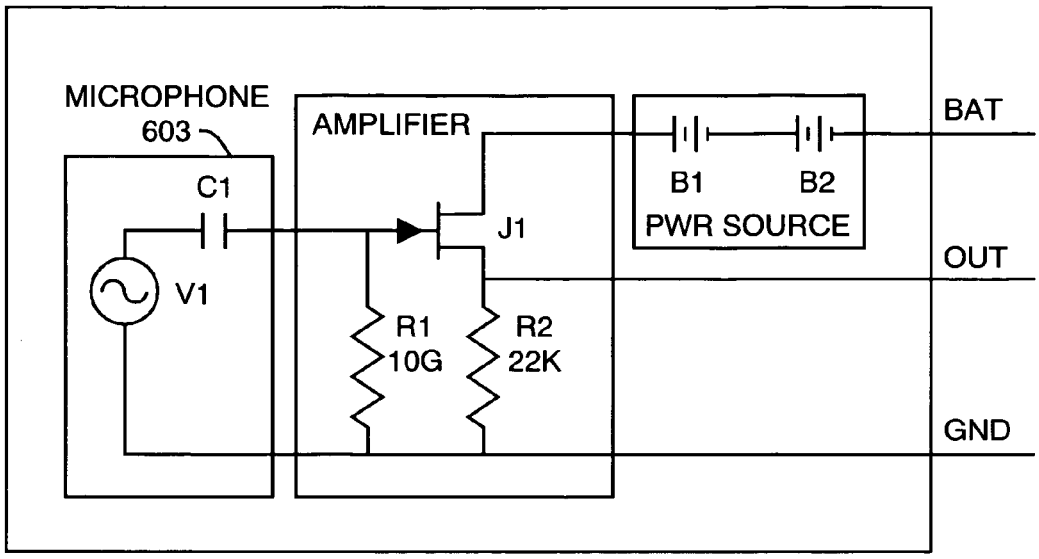
FIG. 28 is a circuit schematic of an alternate embodiment of the invention in which the microphone amplifier is powered by electrochemical cells integrated into the microphone housing.
Figure 29:
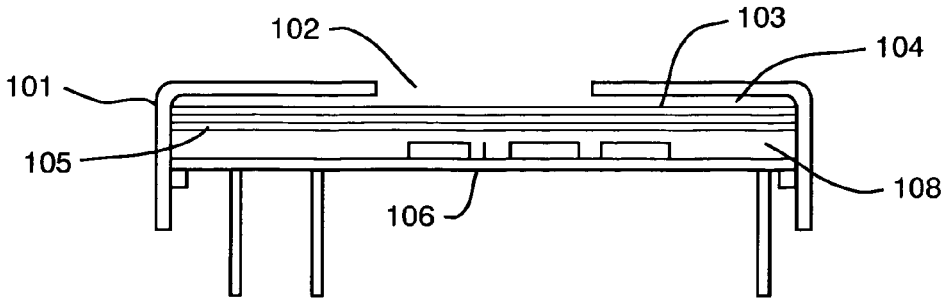
FIG. 29 is a mechanical schematic of the circuit of FIG. 28.
Figure 30:
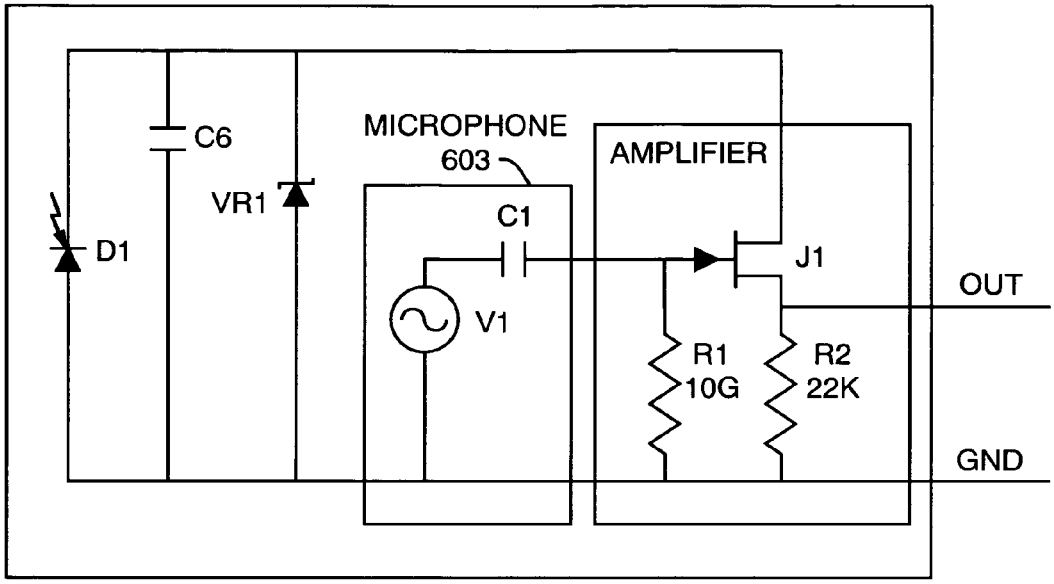
FIG. 30 is a circuit schematic of an alternate solar cell embodiment of the invention.
Figure 31:
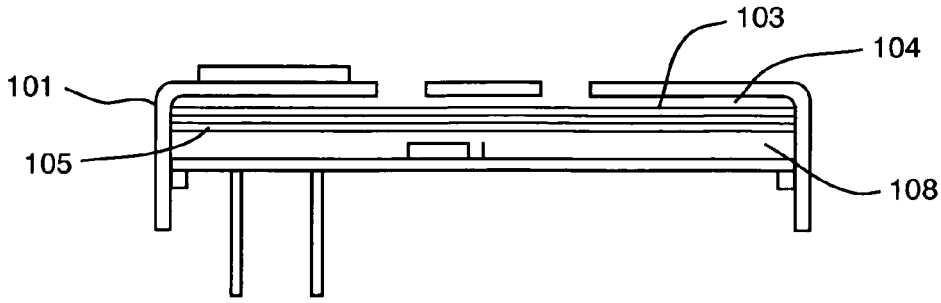
FIG. 31 is a mechanical schematic of the circuit of FIG. 30.

As shown in FIGS. 28 and 29, microphone amplifier J1 is powered by one or more electrochemical cells B1, B2 connected in series. As shown in the figure, two lithium cells B1, B2 provide a total of 6 volts to a JFET amplifier J1. The microphone 103 has three electrical connections (terminals) labeled "GND", "OUT", and "BAT". To turn on the microphone, terminal "BAT" is connected to terminal "GND" by a suitable switch (not shown). The output signal appears between "OUT" and "GND". The electrochemical cells may be of any type such as zinc-air, carbon-zinc, alkaline, silver-oxide, or lithium (shown in the figure). A preferred embodiment uses two lithium cells connected in series and physically located in the back chamber 108 of the housing cover 101 along with the amplifier J1. Electrical connections (not shown) are made between the cells B1, B2 and the JFET by conductive traces on the substrate of the PCB. Alternatively as shown in FIGS. 30 and 31, the amplifier J1 may be powered by a solar cell array D1. The solar cell array may contain any number of parallel-series combinations of individual solar cell elements as long as it is sufficient to provide the desired voltage and current. An optional filter capacitor C6 and an optional voltage regulator VR1 may be included individually or combined in the array. The filter capacitor and voltage regulator will both reduce noise picked up from modulation of the illumination on the solar cell, for example, 60 Hz modulation from indoor lighting. In a preferred embodiment, both a filter capacitor and a simple voltage regulator diode are included.

In FIG. 31, the basic physical construction of the microphone assembly is shown. The solar cell array D1 may be mounted on the face of the microphone exposed to the source of illumination. Although the solar cell array D1 is mounted to partially block the sound inlet to the diaphragm of the microphone, sufficient area is left open so as not to degrade the acoustical performance of the microphone 103. Electrical connections (not shown) provide the electrical connection between the solar cell array and the JFET amplifier. An alternate location for the solar cell array is shown at D1'.

Equivalents

The electret type diaphragm, its preferred dimensions, the different alternative configurations of the spring contact, and the methods of obtaining the electrical contact by electrically conductive epoxy resin are all exemplary in the context of the embodiments described hereinabove. Likewise, the division of the large diaphragm to obtain smaller sized active diaphragms are for illustration only and can be replaced with other substantially similar alternatives. For example, the single large diaphragm may be subdivided into two or three portions as long as the advantages of the relatively large capacitance of the single large diaphragm can still be used to derive the benefit of low noise. The sound inlets 102 in FIGS. 1 and 8 or 409 in FIG. 4 may be of any convenient shape and number without limitation. The electrical connection 107 shown in FIG. 1 or 301 shown in FIG. 8 may be formed suitably in a manner different from what is illustrated.

Also note certain phrases in the claims should be given the broadest possible meaning, for example, in the claims, the phrase, "electrical connection" is used to describe the connection between the backplate and a component on the PCB. This phrase also encompasses an intermediate connection between a trace or conductive element on the PCB substrate and from these to the component.

While this invention has been particularly shown and described with reference to preferred embodiments thereof, it will be understood by those skilled in the art that various changes in form, modification, variation and details may be made therein without departing from the scope of the invention as defined by the appended claims.

What is claimed is:

1. A hearing aid comprising:

a hearing aid enclosure having a faceplate located at a proximal end of said enclosure, said faceplate having sound openings formed through said faceplate;

a housing of lateral width "W" and longitudinal length "L" disposed at the proximal end of said enclosure, the housing containing a transducer formed of a diaphragm comprising an electrically conductive membrane disposed opposite a conductive backplate, said membrane and conductive backplate extending in a plane parallel to and proximate to and opposite the faceplate of said enclosure having sound openings formed through said faceplate; and a printed circuit board (PCB) within the hearing aid enclosure, the housing and the printed circuit board (PCB) being configured to provide an electromagnetic interference (EMI) shield around the transducer.

2. The hearing aid of claim 1 wherein the housing is electrically conductive and is formed of a front surface open to a said faceplate and a sidewall extending longitudinally inward from said faceplate; the PCB having 4 conductive ground plane extending across said sidewall in electrical communication with the housing to form an acoustic seal for the transducer, electrical components to process signals generated by said transducer provided on said PCB; and wherein said housing and PCB form an EMI shield around said components and transducer.

3. The hearing aid of claim 1 wherein the ratio of the area of the housing opposite the faceplate to the area of the faceplate is at least 0.5.

4. The hearing aid of claim 1 wherein the housing has a greater lateral dimension than longitudinal dimension.

* * * * *

UNITED STATES PATENT AND TRADEMARK OFFICE

CERTIFICATE OF CORRECTION

PATENT NO. : 7,003,127 B1
DATED : February 21, 2006
INVENTOR(S) : Walter P. Sjursen et al.

It is certified that error appears in the above-identified patent and that said Letters Patent is hereby corrected as shown below:

Column 22,
Line 28, replace "having 4 conductive" with -- having a conductive --.

Signed and Sealed this

Thirtieth Day of May, 2006

JON W. DUDAS
*Director of the United States Patent and Trademark Office*